US009308432B1

(12) United States Patent
Olson

(10) Patent No.: US 9,308,432 B1
(45) Date of Patent: Apr. 12, 2016

(54) DUAL-EDGED SNOWBOARD AND SNOW SKIS

(71) Applicant: Mervin Manufacturing, Inc., Seattle, WA (US)

(72) Inventor: Michael Olson, Carlsberg, WA (US)

(73) Assignee: Mervin Manufacturing, Inc., Seattle, WA (US)

( * ) Notice: Subject to any disclaimer, the term of this patent is extended or adjusted under 35 U.S.C. 154(b) by 0 days.

(21) Appl. No.: 14/508,936

(22) Filed: Oct. 7, 2014

(51) Int. Cl.
*A63C 5/044* (2006.01)
*A63C 5/048* (2006.01)
*A63C 5/00* (2006.01)

(52) U.S. Cl.
CPC ..... *A63C 5/048* (2013.01); *A63C 5/003* (2013.01); *A63C 5/006* (2013.01)

(58) Field of Classification Search
CPC ..... A63C 5/03; A63C 5/048; A63C 5/0485; A63C 5/003; A63C 5/006; A63C 5/044
USPC ..... 280/14.21, 14.22, 602, 608, 609
See application file for complete search history.

(56) References Cited

U.S. PATENT DOCUMENTS 2,695,178 A * 11/1954 Rheinfrank, Jr. ..... 280/610
3,304,095 A * 2/1967 Carlton ..... 280/609
3,774,254 A * 11/1973 Meyer ..... 441/68
5,083,810 A * 1/1992 Minidis ..... 280/608
5,303,949 A * 4/1994 Harper et al. ..... 280/608
5,462,304 A * 10/1995 Nyman ..... 280/609
5,553,884 A * 9/1996 Abondance ..... 280/609
5,580,078 A * 12/1996 Vance ..... 280/608
5,871,224 A * 2/1999 Vance ..... 280/608
5,957,471 A * 9/1999 Weeks ..... 280/18
6,062,585 A * 5/2000 Hess ..... 280/608
6,193,244 B1 * 2/2001 Vance ..... 280/14.22
6,382,658 B1 * 5/2002 Stubblefield ..... 280/609
6,394,483 B2 * 5/2002 Stubblefield ..... 280/602
6,955,236 B2 * 10/2005 Roberts et al. ..... 180/182
7,073,810 B2 * 7/2006 Wilson ..... 280/609
7,219,916 B2 * 5/2007 Olson ..... 280/609
7,234,721 B2 * 6/2007 DeRocco ..... 280/608
7,275,756 B2 * 10/2007 Turner et al. ..... 280/610
7,311,165 B2 * 12/2007 Roberts et al. ..... 180/182
7,841,089 B2 * 11/2010 Roberts et al. ..... 29/897.2
7,866,684 B2 * 1/2011 Harris et al. ..... 280/609
8,042,827 B2 * 10/2011 Karlsen ..... 280/602
8,246,070 B2 * 8/2012 Lin ..... 280/602
8,256,791 B2 * 9/2012 Gerndt et al. ..... 280/608
8,348,300 B2 * 1/2013 Karlsen ..... 280/609
8,915,503 B2 * 12/2014 Roberts et al. ..... 280/28

(Continued)

*Primary Examiner* — Hau Phan
*Assistant Examiner* — Jacob Meyer
(74) *Attorney, Agent, or Firm* — Lowe Graham Jones PLLC

(57) ABSTRACT

The present disclosure relates to snowboards and skis that include a pair of edges for each longitudinal side of the snowboard or ski. The edges are laterally spaced apart, with one edge being an outer edge and the other edge being an inner edge. The inner edge is positioned vertically lower than the outer edge. The inner edge generally engages the snow surface prior to the outer edge, and is thus a transitional edge. Transitional edges may be rounded edges. The top surface of dual-edges snowboards or ski include an inner portion flanked on each lateral side by a lateral offset. A portion of the inner portion is recessed relative to the lateral offsets. The outer edges are positioned on a base surface of the lateral offsets. The inner edges are positioned on a base surface that is below the interface between the lateral offsets and the inner portion.

15 Claims, 20 Drawing Sheets

(56) References Cited

U.S. PATENT DOCUMENTS

2003/0234129 A1* 12/2003 Roberts et al. ..... 180/182
2005/0077704 A1* 4/2005 Guex et al. ..... 280/610
2006/0033294 A1* 2/2006 Roberts et al. ..... 280/28
2007/0264891 A1* 11/2007 Cheung ..... 441/74
2012/0119470 A1* 5/2012 Gerndt et al. ..... 280/608

* cited by examiner

DUAL-EDGED SNOWBOARD AND SNOW SKIS

TECHNICAL FIELD OF THE INVENTION

The invention relates generally to snowboards and skis and more specifically to snowboards and skis that include dual edges.

BACKGROUND OF THE INVENTION

Snowboards and snow skis travel over terrain covered with snow and/or ice. Depending upon factors such as geographic location, altitude, steepness and aspect of slope, current and recent weather/storm systems, local climate, time of year, time of day, and a myriad of other such factors, the surface of such terrain can vary from "bullet proof" ice to hard-pack snow to deep "fluffy" powder and everything in between. Additionally, in areas where slopes are accessible from chairlifts and other vertical-assist technologies, slopes are often "groomed" with machines. "Grooming" creates a manicured surface that is of greater uniformity than "off-piste" terrain.

These variances of terrain and surfaces results in multiple, and sometimes conflicting, design considerations for the manufacturers of snowboards and skis. In response, specialized snowboards and skis have emerged in which the designs are tuned for a particular terrain, surface condition, and rider ability and/or style. At times, these design decisions limit the usability of the specialized snowboard or skis for other terrain, surface conditions, or riders.

For instance, snowboards designed for use in deep powder are often wider, longer, and less stiff than all-mountain snowboards. Additionally, powder snowboards are typically equipped with a rocker-style longitudinal camber profile and have significant tip and tail regions. A powder snowboard is designed to "float" near the top of the "fluffy" powder surface. Thus, the ability to "edge" a snowboard in powder is less critical than the ability to "edge" a snowboard on icy, hard-pack, or groomed slopes.

In contrast, when riding a snowboard on icy, hard-packed, or groomed slopes, a rider must engage the edges of the snowboard with the surface of the terrain. By carving these edges into the icy or hard-pack surface, the rider has a greater ability to control, turn, and maneuver the snowboard. Accordingly, all-mountain style snowboards are typically less wide, shorter, and less flexible than powder snowboards. These designs enhance the rider's ability to "edge" their board. As another example, still other specialized styles of snowboards are appropriate for terrain parks and pipes. Such boards may be narrower and shorter than all-mountain boards.

It is costly and sometimes inconvenient to have access to multiple types of specialized snowboards or skis for different terrains. Furthermore, because conditions may vary throughout a single day and/or a single ski area, it may be extremely impractical, or even impossible, to employ a different specialized snowboard or pair of skis for each of the different terrain types in a given day of snowboarding or skiing. This problem is compounded in backcountry areas where the rider may have access to only a single snowboard or pair of skis throughout an entire backcountry tour. Even with inbounds riding or skiing, a user may often be in powder during a portion of a run and groomed slopes nearer the lift.

Additionally, depending upon a rider's ability and the terrain, a rider may be "edge-limited." In steep and icy conditions, it may be difficult to maintain enough "edge" to keep the rider from slipping and tumbling down the slope. It is for these and other concerns that the following disclosure is offered.

SUMMARY OF THE INVENTION

The present disclosure is directed towards decks, sled structures, and non-motorized vehicles, such boards and skis, as well as other devices for riding over surfaces, such as snow skates and ski boards. The decks, sled structures, and non-motorized vehicles are configured and arranged to glide on a surface. In some embodiments, the surface may include frozen water molecules, such as snow or ice. In at least one embodiment, the surface includes liquid water. Skis may include snow skis and/or water skis. Boards may include snowboards, surfboards, and/or wakeboards.

In at least one embodiment, a deck is configured and arranged for gliding on snow. The deck includes an inner deck portion and an outer deck portion. The inner deck portion includes an inner base surface, an inner top surface in opposition to and above the inner base surface, and an inner edge disposed adjacent to a longitudinal portion of a perimeter of the inner base surface.

The outer deck portion is disposed adjacent to a longitudinal portion of a perimeter of the inner deck portion. The outer deck portion includes an outer base surface, an outer top surface in opposition to and above the outer base surface, and an outer edge disposed adjacent to a longitudinal portion of a perimeter of the outer base surface.

In at least some embodiments, a region of the inner top surface region is recessed, such that the region of the inner top surface is lower than a laterally adjacent region of the outer top surface. The recessed inner top surface region and the inner top surface that is lower than the laterally adjacent region of the outer top surface forms a longitudinal upper step along an interface between laterally adjacent portions of the inner top surface and the outer top surface.

In some embodiments, the inner edge is lower than the outer edge when the deck is positioned substantially horizontal. The inner base surface may be substantially parallel to the outer base surface. In other embodiments, the inner base surface and the outer base surface may form an angle. The formed angle may be an acute angle. The inner edge may be a rounded edge.

In at least one embodiment, the inner top surface includes a binding region that is configured and arranged to receive a foot binding such that a region of the outer top surface that is laterally adjacent to the binding region is flush with the binding region. The inner edge may include an inner sidecut profile defined by an inner radius of curvature. The outer edge may include an outer sidecut profile defined by an outer radius of curvature. In some embodiments, the inner radius of curvature is greater than the outer radius of curvature. The outer base surface may include a curved surface.

The deck may further include a longitudinal lower step along an interface between laterally adjacent portions of the inner base surface and the outer base surface. In at least one embodiment, the inner edge is disposed longitudinally along the lower step. The upper step may be substantially above the lower step for at least a portion of a longitudinal length of the upper step. Portions of the upper step may track corresponding portions of the lower step and/or inner edge. In at least one embodiment, another region of the inner top surface is at least flush with another laterally adjacent region of the outer top surface such that the inner top surface corresponding to the flush region is vertically displaced from the inner base surface by a first thickness. The inner top surface corresponding to the recessed region may be vertically displaced from the inner base surface by the second thickness. The first thickness is greater than the second thickness. The outer edge is a serrated edge in at least one embodiment.

In at least one embodiment, a first longitudinal portion of the deck includes a portion of the outer edge and an entirety of the inner edge. A second longitudinal portion of the deck includes another portion of the outer edge, such that the second longitudinal portion of the deck does not include any portion of the inner edge. In some embodiments, the first longitudinal portion is a first half and the second longitudinal portion is a second half of the deck. The first longitudinal half may be the half that includes the tail portion of the deck and the second longitudinal half includes the tip portion of the deck. In an alternative embodiment, the first longitudinal half is the half that includes the tip portion of the deck and the second longitudinal half includes the tail portion of the deck.

The deck may be configured to glide on a surface that includes at least one of frozen water molecules or liquid water molecules. In various embodiments, the outer edge is an adjustable outer edge. The deck further includes an angled surface that provides a sloped transition between the inner edge and the outer edge. The deck may include an adjustable outer edge accessory that enables an adjustable transition between the inner edge and the outer edge. The adjustable outer edge may be a removable adjustable outer edge accessory.

In some embodiments, a sled structure is configured and arranged for gliding on snow. The sled structure includes a top deck surface and a base deck surface. The top deck surface includes an inner top surface, an outer top surface that is disposed laterally adjacent to the inner top surface, and an upper step disposed along an upper interface formed by laterally adjacent portions of the inner top surface and the outer top surface.

The base deck surface includes an inner base surface in opposition to and below the inner top surface, an outer base surface disposed laterally adjacent to the inner base surface and in opposition to and below the outer top surface, an inner edge disposed along a lower interface formed by laterally adjacent portions of the inner base surface and the outer base surface, and an outer edge disposed at an outer perimeter of the outer base surface.

In at least one embodiment, a non-motorized snow vehicle is configured and arranged for gliding on snow. The vehicle includes an inner top surface, an inner base surface that is below the inner top surface, an outer top surface laterally adjacent to the inner top surface, and an outer base surface that is below the outer top surface. The vehicle may also include an inner edge disposed along a longitudinal interface formed by laterally adjacent portions on the inner base surface and the outer base surface such that the inner edge includes an inner sidecut profile defined by an inner radius of curvature. In some embodiments, the vehicle further includes an outer edge disposed along a longitudinal outer perimeter of the outer base surface. The outer edge may include an outer sidecut profile defined by an outer radius of curvature, wherein the inner radius of curvature is greater than the outer radius of curvature.

Some embodiments of decks include an upper deck surface, a lower deck surface, and a longitudinal axis of symmetry that subdivides the deck into a first longitudinal portion and a second longitudinal portion. The lower deck surface is configured and arranged to glide on a snow surface. Some embodiments may include an outer snow carving means positioned on the lower deck surface of the first longitudinal portion. At least one embodiment includes an inner snow carving means disposed on the lower deck surface of the first longitudinal portion. The inner snow carving means may be intermediate the outer snow carving means and the longitudinal axis of symmetry. In some embodiments a snow carving means is an edge. Some embodiments include a means for coupling a rider's foot to the upper deck surface, such as a binding.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

To facilitate the understanding of this invention, a number of terms are defined below. Terms defined herein have meanings as commonly understood by a person of ordinary skill in the areas relevant to the present invention. Terms such as "a," "an," and "the" are not intended to refer to only a singular entity, but include the general class of which a specific example may be used for illustration. The terminology herein is used to describe specific embodiments of the invention, but their usage does not delimit the invention, except as outlined in the claims.

As will become apparent in the discussion regarding FIGS. 1-13, snowboards and snow skis are three-dimensional objects that are very roughly defined by a plane. Longitudinal and lateral dimensions of snowboards and skis are generally found in this plane. However, being a three-dimensional object, the structures included in snowboards and skis are not constrained to this plane. For reference purposes used herein, the snowboard and ski plane is parallel with a horizontal plane. Additionally for reference purposes, this plane defines a vertical direction that is orthogonal to this plane.

The most significant dimension of the snowboard or ski is generally understood to be the longitudinal dimension or direction along the major axis of the snowboard or ski. The longitudinal dimension lies within the plane defined by the snowboard or ski. The lateral dimension or direction is the dimension that is orthogonal to the longitudinal dimension and lies with the plane. The vertical dimension is orthogonal to each of the longitudinal and lateral dimensions.

As used herein, the terms upper and lower are relative terms and each refers to the vertical direction defined by the plane of the snowboard or ski. Specifically, upper refers to a location or feature that is at a greater vertical location, with respect to the snowboard or ski plane, than a lower location or feature. For instance, the top surface of a snowboard is an above or "upper" surface, while the base surface is a "lower" surface.

As used herein, the terms inner and outer are relative terms and generally refer to relative locations along the lateral dimension of the snowboard or ski. Specifically, outer refers to a location more proximate to one of the two lateral sides of a snowboard or ski (i.e., further from the major axis of the snowboard or ski), while inner refers to a location less proximate to one of the two lateral sides (i.e., closer to the major axis of the snowboard or ski). Likewise, forward and rearward are relative terms that refer to the longitudinal dimension of a snowboard or ski. For instance, the tip or shovel of a snowboard is forward of the rearward tail of the snowboard.

Figure 1:
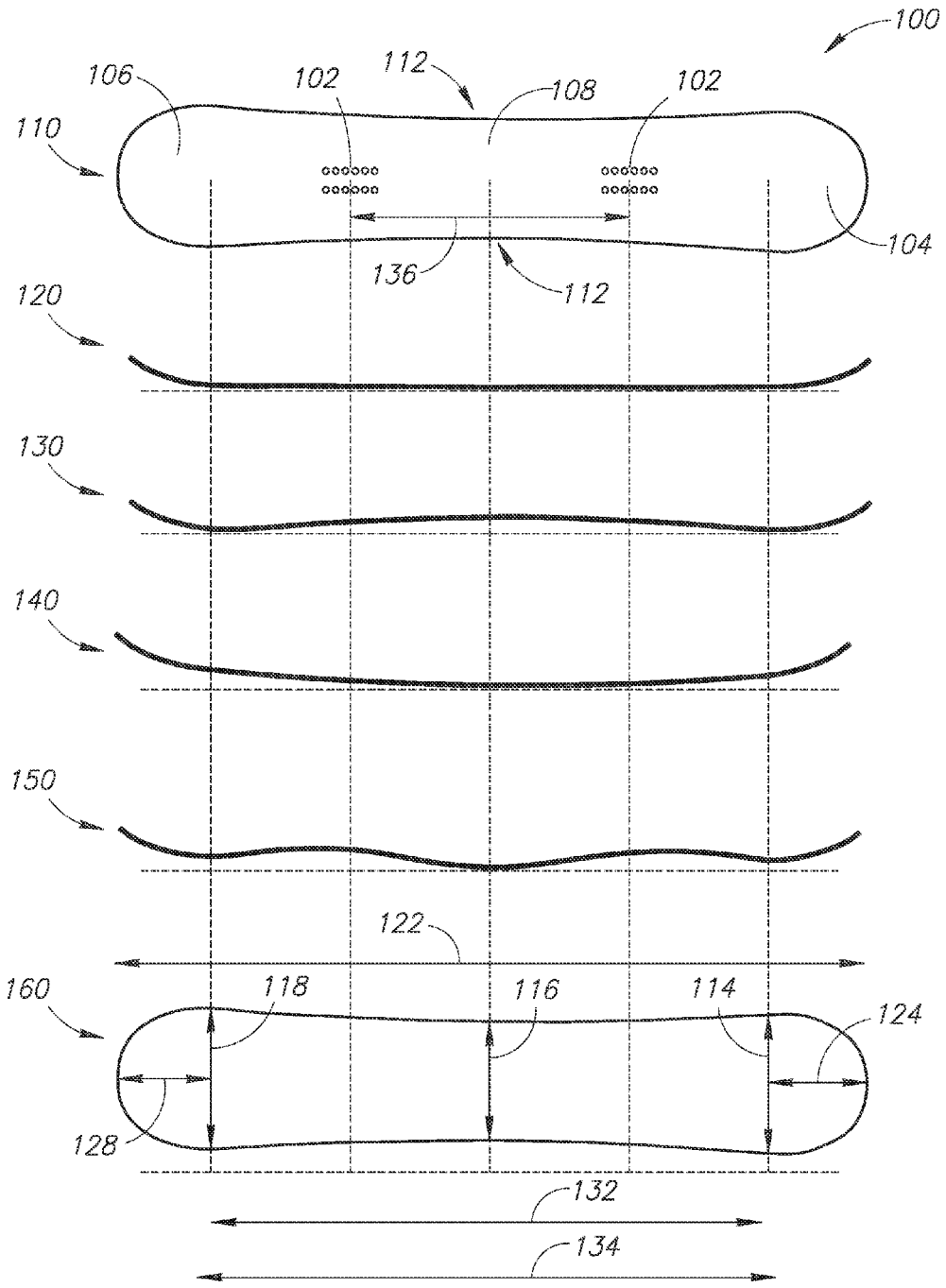
FIG. 1 illustrates various orthographic views and features of snowboards consistent with the embodiments disclosed herein.

FIG. 1 illustrates various orthographic views and features of snowboards consistent with the embodiments disclosed herein. Top view 110 shows the top surface of snowboard 100. Snowboard 100 includes binding mount inserts 102 located in a binding region on the top surface of snowboard 100. Binding mount inserts 102 enable adjustably coupling bindings (not shown) to snowboard 100. Bindings are employed to couple a rider's feet to snowboard 100.

There are two sets of binding inserts 102, one set for a forward binding, and one set for a rearward binding. The forward binding couples the rider's front foot to the board, while the rearward binding couples the rider's back foot to the board. Because multiple holes are included in each set of binding inserts 102, the distance between each binding may be adjusted to achieve the appropriate stance width 136 for a particular rider. The binding baseplate may extend nearly from one upper lateral edge of the board to the other, depending on the binding model and the width of the board.

The heel region of the feet (and consequently the bindings) are positioned more proximate to one of the lateral sides of snowboard 100 and the corresponding toe regions of the feet (and bindings) are positioned more proximate to the other lateral side of snowboard 100. Accordingly, the lateral side of snowboard 100 that is more proximate to the heel region is the heel-side of snowboard 100. Likewise, the lateral side of snowboard 100 that is more proximate to the toe region is referred to as the toe-side of snowboard 100. However, depending on whether the particular rider prefers "regular" or "goofy" foot setup, these sides may be interchangeable. In other words, the bindings may be mounted for the toe side to the left side or to the right side of the board.

Snowboard 100 includes a waist region 108 located between the two sets of binding inserts 102. In typical riding conditions, the rider's center-of-mass is generally above waist region 108. Snowboard 100 also includes a tip 104 at a forward longitudinal end and a tail 106 at the rearward longitudinal end of snowboard 100. Both the tip 104 and tail 106 are curved regions of snowboard 100 that curve upward and away from the horizontal plane defined by snowboard 100. The tip 104 and tail 106 enable snowboard 100 to glide or float on the upper surface of snow, while minimizing snowplow-like resistance.

In preferred embodiments, each of the lateral sides of snowboard 100 includes a concave sidecut 112. Sidecuts 112 provide a curved, and thus greater, edging surface area when turning. Sidecuts 112 enable easier maneuvering of snowboard 100. A radius of curvature may characterize sidecuts 112.

Snowboard 100 may be manufactured to include various camber profiles. A particular camber profile may be chosen based on the rider's experience level, riding style, expected terrain, snow conditions, and other such factors. Side view 120 illustrates a flat profile while side view 130 illustrates a traditional positive-camber profile. Side view 140 illustrates a reverse-camber or rocker profile and side view 150 illustrates a combo profile that includes aspects of both a traditional cambered profile and a rockered profile.

Bottom view 160 illustrates the base, or bottom surface, of snowboard 100. The base surface is the surface that glides along the snow when the rider is riding. Snowboard 100 may be characterized by various snowboard parameters. Snowboard parameters may include linear dimensions of some of the features of snowboard 100. For instance, snowboard parameters may include waist width 116, which is the lateral width of snowboard 100 at the narrowest portion of the waist region 108. Snowboard parameters may include lateral dimensions at other regions of snowboard 100, such as tip width 114 and tail width 118. Note that the width may be measured at the widest part of the tip or shovel of the board or at the forward contact point (FCP) of the board. Like measurements may be made for the tail.

Longitudinal lengths may also be included as snowboard parameters, such as the shovel or tip length 124 and tail length 128. The longitudinal length between the forward-most portion of tip 104 and the rearward-most portion of tail 106 may be defined as the snowboard length 122. Likewise, the longitudinal distance between the rearward portion of tip 104 and the forward portion of tail 106 may be defined as the contact length 132. Depending on the camber profile of snowboard 100, contact length 132 indicates the approximate longitudinal length of the base that is in contact with the snow when snowboard 100 is ridden.

Additionally, effective edge length 134 indicates the longitudinal length of a snowboard edge that is in contact with the snow when the snowboard is undergoing a turn, or carving, on a snow surface. As shown in bottom view 160, 15, effective edge length 134 is often, depending upon other snowboard characteristics such as camber profile and side cut 112, slightly longer than contact length 134.

Figure 2:
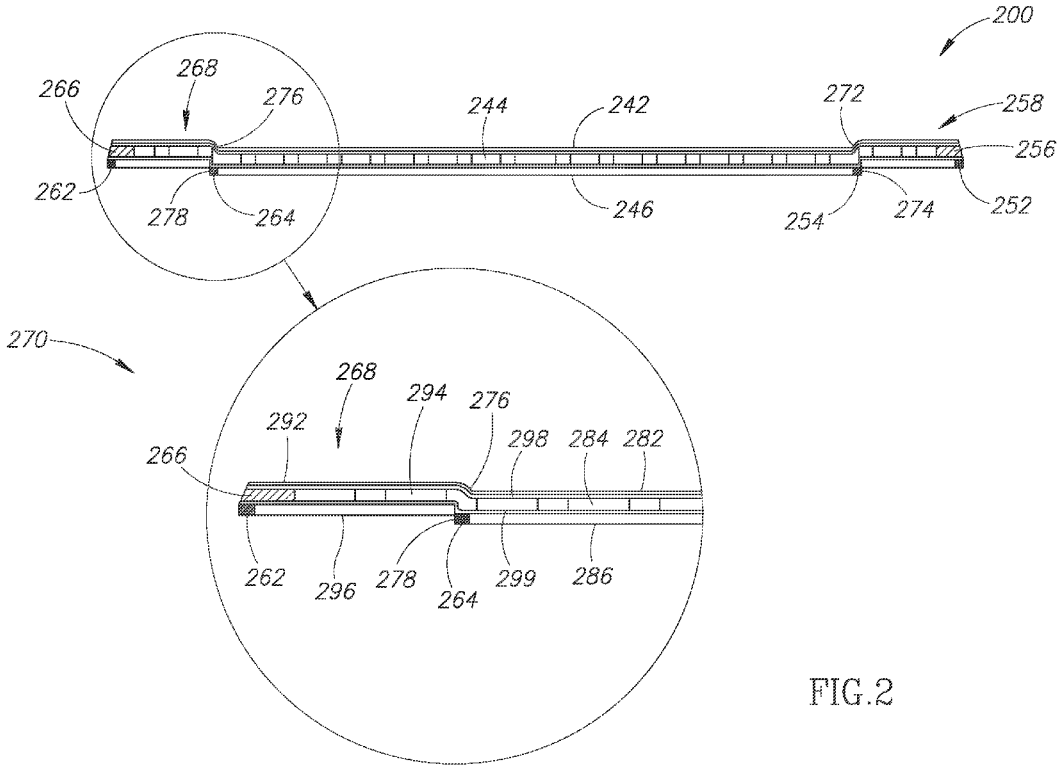
FIG. 2 illustrates a lateral cross section of a dual-edged snowboard that includes parallel lateral offsets. The cross-sectioned portion includes an inner recessed top surface. The snowboard is consistent with the various embodiments disclosed herein.

FIG. 2 illustrates a lateral cross section of a dual-edged (DE) snowboard 200 that includes parallel lateral offsets. The cross-sectioned portion includes an inner recessed top surface. DE snowboard 200 is consistent with the various embodiments disclosed herein. The lower portion of FIG. 2, which is within the larger of the two circular boundaries, illustrates a magnified portion of the heel-side lateral cross section 270 that is within the smaller circular boundary in the upper portion of FIG. 2.

As illustrated in the upper portion of FIG. 2. DE snowboard 200 includes an upper layer 242, such as a top sheet, and a lower base layer. Lower base layer, or simply base 246, provides a surface that glides on the snow when DE snowboard 200 is ridden. Upper layer 242 may include an upper surface and one or more other layers. Snowboard core 244 is interposed between upper layer 242 and base 246. Core 244 may be constructed from any suitable snowboard core material, including but not limited to wood, foam, aluminum, and/or one or more composite materials. Core 244 may include poplar, obeche, and/or birch wood. As shown in FIG. 2, core 244 may be constructed from strips of wood laminated together to create the desired flexibility, rigidity, strength, and mass of DE snowboard 200. The core is preferably a soft wood.

The basalt composite and the soft core allow the stiffness of the board to be somewhat defined by the section shape of the board. Thus, even with the stiffening effect of the vertically offset outer portions of the board, the overall flex of the board can be tailored to be within a preferred range.

In some alternative embodiments, core 244 may include a honeycomb structure to decrease the overall mass and provide flexibility to DE snowboard 200. In a preferable embodiment, core 242 includes paulownia wood, which reduces the stiffness and/or enhances the flexibility of DE snowboard 200.

In some embodiments, upper layer 242 is constructed from one or more surfaces or layers. A structural layer is interposed between the upper layer and the core and between the base and the core. The structural layer is preferably a composite material such as a resin-impregnated fiberglass or more preferably a basalt glass fiber composite. The basalt fiber composite reduces the stiffness and/or enhances the flexibility of the board. For instance, upper layer 242 may include a top sheet and one or more layers of fibers sandwiched, or interposed, between top sheet and core 244. For these embodiments, the top sheet may be the upper surface of DE snowboard 200. The top sheet provides protection for the fiber layer and core 244. Likewise, the base, in addition to providing a gliding surface, provides a protective layer over the composite structural layer positioned between the base and the core.

In some embodiments, the top sheet includes graphics, such as a manufacture's trademark, to provide branding opportunities and personalization of the appearance of DE snowboard 200. In some embodiments, the top sheet may be a plastic top sheet, such as a polyurethane top sheet.

In various embodiments, base 246 is constructed from a synthetic plastic, such as polyethylene. In a preferred embodiment, base 246 is constructed from an ultra-high-molecular-weight polyethylene, such as P-TEX®. Base 246 may be an extruded material. In some embodiments, base 246 is a sintered material. As discussed above, one or more fiber layers may be sandwiched between base 246 and core 244.

DE snowboard 200 may include one or more metal layers interposed between core 244 and base 246 and/or between core 244 and upper layer 242.

DE snowboard 200 includes toe-side offset 258 and heel-side offset 268. In the embodiment shown in FIG. 2, each of these offsets is a parallel offset. Specifically, toe-side offset 258 is substantially parallel with heel-side offset 268 and with the horizontal plane defined by the portion of DE snowboard 200 intermediate the two offsets. In some embodiments, the portion of DE snowboard 200 intermediate the two offset may be an inner portion of DE snowboard 200.

In addition, each of toe-side offset 258 and heel-side offset 268 are displaced vertically from the inner portion of DE snowboard 200. Because the offsets are vertically displaced upwardly from the inner portion, as illustrated in FIG. 2, the inner portion of DE snowboard 200 is a recessed portion of DE snowboard 200. A magnified portion of the heel-side lateral cross section 270 is shown in the lower portion of FIG. 2.

Heel-side offset 268 includes heel-side sidewall t and heel-side outer edge 262. As shown in the magnified portion of the heel-side lateral cross section 270, heel-side offset 268 includes heel-side outer upper layer 292 and heel-side outer base 296. Heel-side outer core 294 is interposed between heel-side outer upper layer 292 and heel-side outer base 296. Heel-side sidewall 266 is intermediate the outermost portion of heel-side outer upper layer 292 and heel-side outer base 296. Heel-side sidewall 266 is adjacent to the outermost portion of heel-side outer core 294. Heel-side sidewall 266 forms a lateral sidewall of DE snowboard 200. Heel-side outer edge 262 is disposed on the outer lateral corner formed by the intersection of heel-side sidewall 266 and heel-side outer base 296.

Also illustrated in magnified cross section 270 is that the recessed inner portion of DE snowboard 200 includes heel-side inner upper layer 282 and heel-side inner base 286. Heel-side inner core 284 is interposed between heel-side inner upper layer 282 and heel-side inner base 286.

In preferred embodiments, a structural layer is disposed between core 244 and upper layer 242. Likewise, a structural layer may be disposed between core 244 and the base 246. FIG. 2 illustrates upper structural layer 298 positioned between heel-side inner core 284 and heel-side inner upper layer 282. FIG. 2 also illustrates lower structural layer 299 positioned between heel-side inner core 284 and heel-side inner base 286.

In some embodiments, core 244 is sandwiched between upper structural layer 298 and lower structural layer 299. In at least one embodiment, each of upper structural layer 298 and lower structural layer 299 wrap around the lateral sides of core 244 so that the structural layers encase core 244. In such embodiments, portions of the structural layers are disposed intermediate heel-side sidewall 266 and the heel-side lateral edge of core 244. Likewise, portions of the structural layers are disposed intermediate toe-side sidewall 256 and the toe-side lateral edge of core 244. As discussed above, structural layers are preferably constructed from composite materials, such as basalt fibers, fiberglass, carbon fibers, and the like. Upper structural layer 298 and lower structural layer 299 may be employed to tailor the stiffness and/or flexibility of DE snowboard 200.

Heel-side inner edge 264 is disposed at the lateral corner formed by the intersection of heel-side outer base 296 and heel-side inner base 286. Heel-side inner upper layer 282, heel-side inner core 264, heel-side inner base 286, along with corresponding toe-side upper layer, toe-side inner core, and toe-side inner base form the recessed inner portion of DE snowboard 200. Because heel-side offset 268 is vertically offset from the inner portion of DE snowboard 200, a heel-side lower step 278 is formed on base 246. The heel-side lower step 278 is disposed along an interface between heel-side outer base 296 and heel-side inner base 286. As illustrated in FIG. 2, heel-side inner edge 264 is disposed at the lower corner formed by heel-side lower step 278.

Likewise, heel-side upper step 276 is disposed along an interface between heel-side outer upper layer 292 and heel-side inner upper layer 282. Heel-side inner upper layer 282 is at a vertical height that is less than the vertical height of heel-side outer upper layer 292. Thus, heel-side inner upper layer 282 is recessed from heel-side outer upper layer 292. Likewise, heel-side inner base 286 is at a vertical height that is less than the vertical height of heel-side outer base 296.

At least one of heel-side outer edge 262 and heel-side inner edge 264 may be a metal edge. In some embodiments, at least one of these edges is a steel edge. In some embodiments, the lateral dimension of at least one of these edges is between 0.050 and 0.100 inches. In a preferred embodiment, the lateral dimension of at least one of heel-side outer edge 262 and heel-side inner edge 264 is 0.080 inches. In some embodiments, the vertical dimension of at least one of these edges is between 0.050 and 0.100 inches. In a preferred embodiment, the vertical dimension of both heel-side outer edge 262 and heel-side inner edge 264 is 0.080 inches.

The width of the waist region of DE snowboard 200 varies depending upon various factors, such as rider's height, weight, skill, and terrain type. For instance, various embodiments of DE snowboard 200 include a waist region width between 9 and 12 inches. Accordingly in various embodiments, the ratio of the width of one of the offsets, such as toe-side offset 258 or heel-side offset 268, to the width of the board varies between approximately 0.005 and 0.01. Additionally, the angle that a tangent line drawn from the outer edge to the inner edge makes with the horizontal may vary between 2° and 4°, depending upon the width and vertical height of the offset.

Both heel-side outer edge 262 and heel-side inner edge 264 may be configured and arranged to carve, or edge, into a snow surface to enable the rider to control, turn, and/or maneuver DE snowboard 200. The snow surface may be slope, such as a mountain or hill slope, with a gradient that includes a vertical (with respect to gravity) component. Although the dynamics of a heel-side turn is discussed below, because of DE snowboard 200, the discussion equally applies to toe-side turns.

Because heel-side inner edge 264 is recessed relative to heel-side outer edge 262, when the rider initiates a heel-side turn by edging on their heel-side, heel-side inner edge 264 will initially engage with the slope. Since the inner edge 264 is lower and narrower than the full width of the board, an easy turn initiation results as the board rocks up onto first the inner edge, then the outer edge. This initial edging will initiate the turn and provide a first edging force and a first edging torque to counteract gravity and allow the rider to control the "parallel to the slope" component of DE snowboard's 200 motion relative to the "orthogonal to the slope" component of DE snowboard's 200 motion.

As the rider more aggressively edges into the heel-side turn. DE snowboard rotates about a longitudinal axis and the heel-side outer edge 262 engages with the slope. The engagement of heel-side outer edge 262 with the slope provides a second edging force and a second edging torque that further counteracts gravity and allows the rider to further control the "parallel to the slope" component of DE snowboard's 200 motion relative to the "orthogonal to the slope" component of DE snowboard's 200 motion. Because the edging forces and torques are distributed along two edges, with differing lever arms, the rider experiences an enhanced ability to carve the turn. In steep and/or icy terrain, a rider may experience difficulty maintaining a single edge throughout a low-angled turn. In such "edge-limited" situations, the enhanced edging ability provided by dual edges may allow the rider to safely negotiate terrain that would otherwise be unsafe on a snowboard with only a single edge on each lateral side.

In some embodiments, the tangents at each location of the two edges are substantially parallel tangents. As discussed in the context of FIG. 11, in other embodiments, because of the differing curvature of the inner and outer edges, the edges are not substantially parallel. Because the inner edge is the first edge to engage with the sloe when transitioning into a turn and the last edge to disengage with the slope when transitioning out of a turn, the inner edge may be a transitional edge.

In some embodiments, the lateral width of heel-side offset 268 (the horizontal distance between heel-side outer edge 262 and heel-side inner edge 264) is between 1.0 and 3.0 inches. In a preferred embodiment, the lateral width of heel-side offset 268 is 1.25 inches. In another preferred embodiment, the lateral width of heel-side offset 268 is 1.5 inches.

In some embodiments, the thickness of DE snowboard 200 (the vertical distance between the top surface of upper layer 242 and the bottom surface of base 246) varies with the lateral location across DE snowboard 200. In some embodiments, the thickness of the inner portion of DE snowboard 200 (the vertical distance between the top surface of heel-side inner upper layer 282 and the bottom surface of heel-side inner base 286) is between 0.30 and 0.45 inches. In a preferred embodiment, the thickness of the inner portion of DE snowboard 200 is 0.40 inches. In some embodiments, the thickness of heel-side offset 268 (the vertical distance between the top surface of heel-side outer upper layer 292 and the bottom surface of heel-side outer base 292) is between 0.10 and 0.30 inches. In a preferred embodiment, the thickness of heel-side offset 268 is 0.20 inches.

The vertical distance between the heel-side outer base 296 and the heel-side inner base 286 (or equivalently the vertical distance between heel-side outer edge 262 and heel-side inner edge 264) may be the drop of DE snowboard 200. In some embodiments, the drop is between 0.040 inches and 0.150 inches. In a preferred embodiment, the drop is 0.060 inches. In another preferred embodiment, the drop is 0.080 inches. In an alternative embodiment, the drop is 0.120 inches. In at least one embodiment, the vertical height of heel-side lower step 278 is equal to the drop height.

A tangent line between the lower outer corner of heel-side outer edge 262 and the lower outer corner of heel-side inner edge 264 may be constructed. The ratio between the drop and the lateral width of heel-side offset 268 defines the angle this tangent line makes below a horizontal line. In preferred embodiments, this angle is between 2° and 4°, although other embodiments are not so constrained.

In a preferred embodiment, DE snowboard 200 is substantially symmetrical about a longitudinal axis passing through the center-of-mass of DE snowboard 200. Thus, toe-side offset 258 is substantially similar to heel-side offset 268, including similar widths However, various embodiments are not so constrained and symmetry between the offsets is not required. For instance, the heel-side offset 268 may be wider than the toe-side offset 258. Toe-side offset 268 includes toe-side outer edge 252, toe-side sidewall 256, and toe-side inner edge 254. The vertical displacement of toe-side offset forms toe-side upper step 272 and toe-side lower step 274.

Because of the preferred symmetry about the longitudinal axis, the above discussion regarding the features of the heel-side of DE snowboard 200 applies equally to the toe-side of DE snowboard 200. Accordingly, whether the rider is performing a heel-side turn or a toe-side turn, the rider can exploit the advantages of the dual edges, which provide greater control and maneuverability throughout the turn. Likewise, the advantages are received whether the rider prefers "regular" or "goofy" foot forward riding. The dual-edge in DE snowboard 200 is in reference to the two, laterally spaced apart, longitudinal edges on the heel-side (heel-side outer edge 262 and heel-side inner edge 264) as well as the two, laterally spaced apart, longitudinal edges on the toe-side (toe-side outer edge 252 and toe-side inner edge 254) of DE snowboard 200.

In addition, when riding flat on icy, hard-pack, or groomed surfaces, only the inner base portions glide over the snow, because heel-side outer base 296 and toe-side outer base are positioned at a vertical height, equivalent to the drop, above the inner base portions. Thus, the "effective" width of DE snowboard 200 when flat gliding, in icy, hard-pack, or groomed terrain, is the width between heel-side inner edge 264 and toe-side inner edge 254. This reduced "effective" width in hard-pack or groomed terrain is significantly beneficial in flat surfaces, such as lift lines or flat spots between pitches, where "fatter" powder boards make traversing the terrain difficult. In some embodiments, the reduced "effective" width of DE snowboard 200 results in a faster snowboard because there is less surface area making contact with the snow surface. Then, when the board is edged on such surfaces, the transition to a carve is easier with the initiation of the carve occurring with the narrower inner edge.

In contrast, in powder conditions, the inner base portions, as well as heel-side outer base 296 and toe-side outer base glide over the snow. This is because DE snowboard 200 is slightly submerged on the "fluffy" surface in powder conditions, allowing the base portions of heel-side offset 268 and toe-side offset 258 to make contact with the powder. Thus, the "effective" width of DE snowboard 200 in powder conditions is the width between heel-side outer edge 262 and toe-side outer edge 252. The "effective width" of DE snowboard 200 in powder conditions is greater than the "effective" width on more dense surfaces, at least partially obviating the need for specialized boards tuned for the different surfaces. Additionally, advantageous floatation results.

Additionally, the flexibility of DE snowboard 200 may be increased by the use of paulownia wood in core 244. The flexibility of DE snowboard 200 may be increased by the use of fiberglass of basalt fibers in one or layers in DE snowboard 200. The ability to tune the flexibility of DE snowboard without substantially affecting width and length snowboard parameters further obviates the need for specialized boards tuned for the different surfaces and terrains. In at least one embodiment, DE snowboard 200 may be a splitboard.

Figure 3:
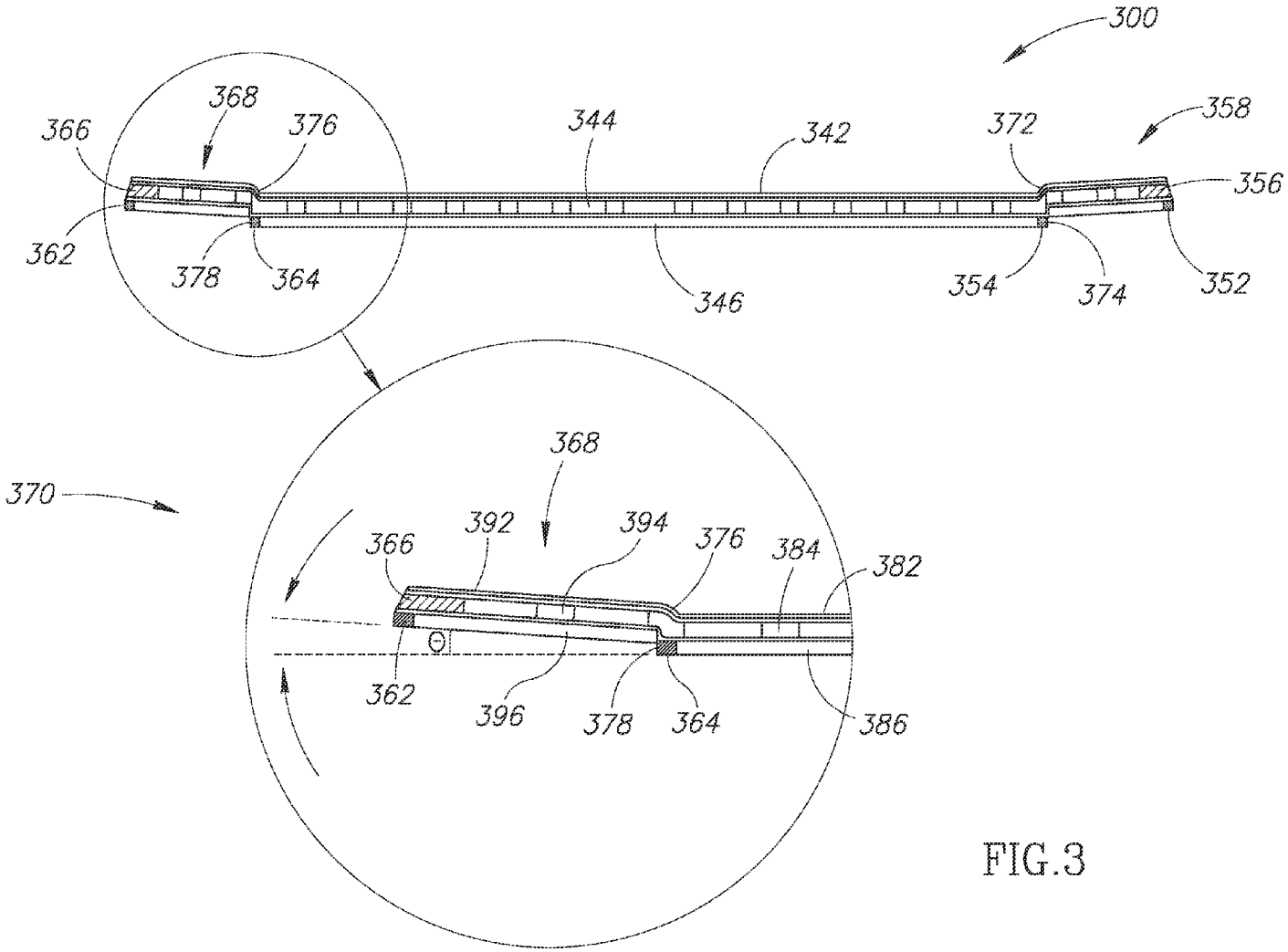
FIG. 3 illustrates a lateral cross section of a dual-edged snowboard that includes upwardly angled lateral offsets and the cross-sectioned portion includes a recessed top surface, the snowboard being consistent with the various embodiments disclosed herein.

FIG. 3 illustrates a lateral cross section of DE snowboard 300 that includes upwardly angled lateral offsets. The cross-sectioned portion includes an inner recessed top surface. DE snowboard 300 is consistent with the various embodiments disclosed herein. The lower portion of FIG. 3, which is within the larger of the two circular boundaries, illustrates a magnified portion of the heel-side lateral cross section 370 that is within the smaller circular boundary in the upper portion of FIG. 3.

Similar to the embodiment illustrated in FIG. 2, DE snowboard 300 includes an upper layer 342, a core 344, and a base 346. DE snowboard 300 also includes a heel-side offset 368 and a toe-side offset 358. Toe-side offset 358 includes toe-side sidewall 356 and toe-side outer edge 352. To form the dual, laterally spaced apart, longitudinal edges of the toe-side, DE snowboard 300 includes toe-side inner edge 354. Toe-side lower step 374 is formed by the corner of toe-side inner edge 354. Likewise. because the inner portion of DE snowboard 300 is recessed, toe-side upper step 372 is formed at the interface between the inner portion and the toe-side offset 358.

A magnified portion of the heel-side lateral cross section 370 is illustrated in FIG. 3. Substantially symmetrical to the toe-side, the heel-side portion of DE snowboard 300 includes heel-side offset 368. Heel-side offset 368 includes heel-side outer upper layer 392, heel-side outer core 394, heel-side outer base 396, and heel-side sidewall 366. The heel-side of DE snowboard 300 also includes heel-side inner upper layer 382, heel-side inner core 384, and heel-side inner base 386. The dual edges on the heel-side are heel-side outer edge 362 and heel-side inner edge 364. Heel-side upper step 376 and heel-side lower step 378 are also shown in FIG. 3.

In contrast to the parallel offsets of the embodiment illustrated FIG. 2, heel-side offset 368 and toe-side offset 358 are upwardly angled at an angle of θ with the horizontal. In some embodiments, θ is between 1° and 15°. The upward angle θ provides a greater transition time between when the inner edge engages with the slope and when the outer edge engages with the slope (and also between when the outer edge disengages with the slope and the inner edge disengages with the slope). This increase in engagement/disengagement time results in different riding characteristics of DE snowboard 300. This transition time may be varied by the angle θ. In some embodiments, a larger upwardly sloping angle θ is chosen for riders that only need to engage the outer edges in steeper or aggressive terrain.

Additionally, the upwardly sloping offsets at angle θ provide greater clearance of the outer edges for when DE snowboard 300 is ridden in freestyle parks and half pipes. The upwardly sloping angle θ obviates the need for a specialized board for terrain parks. For example, the rider can ride the board flat on a pipe or box with less risk that the outer edge will engage the pipe or box. This is a situation in which the inner edge may be rounded or dulled for less engagement. Thus, such obstacles may be ridden without sacrificing the effectiveness of the board on all-mountain terrain outside the park.

Figure 4:
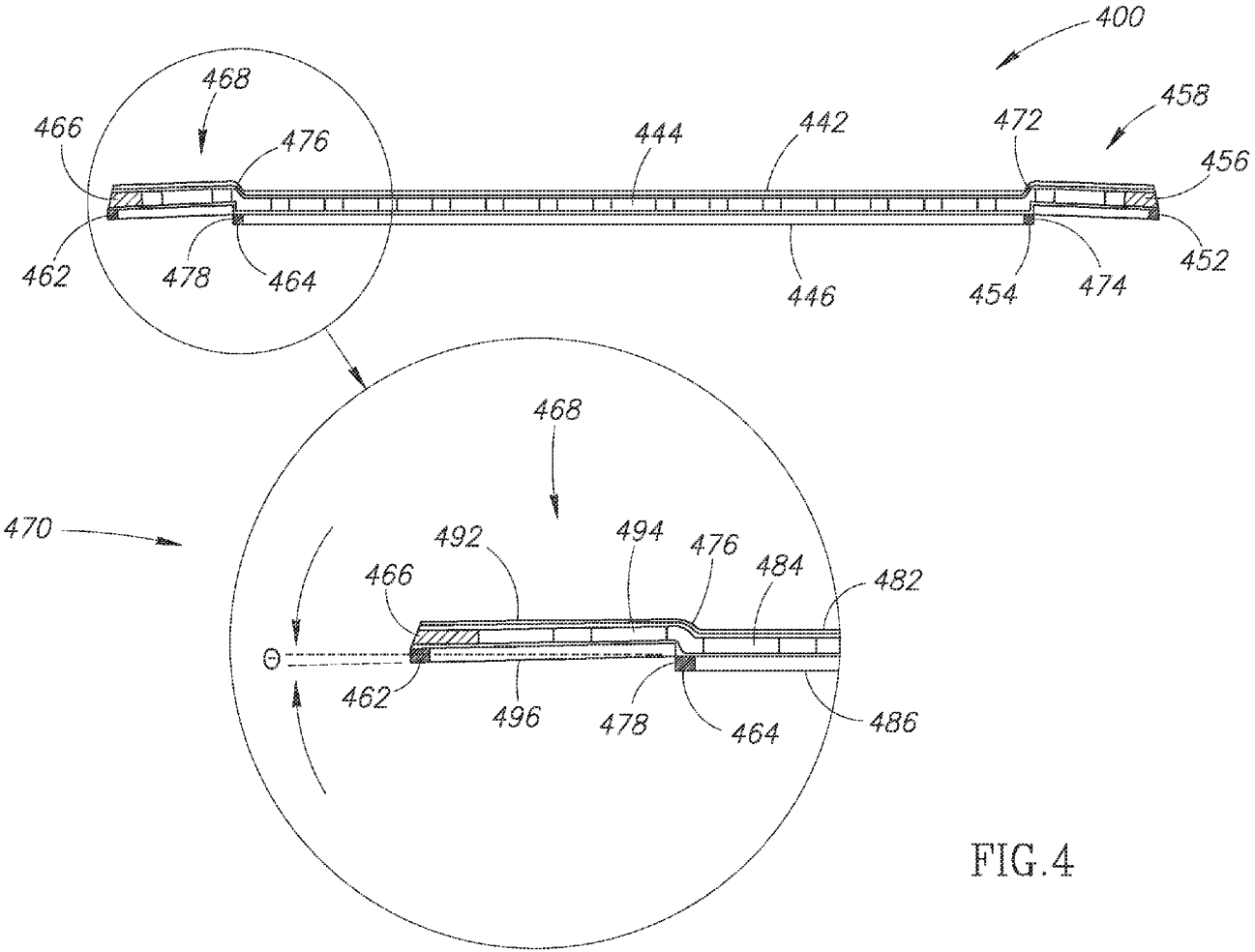
FIG. 4 illustrates a lateral cross section of a dual-edged snowboard that includes downwardly angled lateral offsets and the cross-sectioned portion includes a recessed top surface, the snowboard being consistent with the various embodiments disclosed herein.

FIG. 4 illustrates a lateral cross section of DE snowboard 400 that includes downwardly angled lateral offsets. The cross-sectioned portion includes an inner recessed top surface. DE snowboard 400 is consistent with the various embodiments disclosed herein. The lower portion of FIG. 4, which is within the larger of the two circular boundaries, illustrates a magnified portion of the heel-side lateral cross section 470 that is within the smaller circular boundary in the upper portion of FIG. 4.

Similar to the embodiments illustrated in FIGS. 2 and 3, DE snowboard 400 includes an upper layer 442, a core 444, and a base 446. DE snowboard 400 also includes a heel-side offset 468 and a toe-side offset 458. Toe-side offset 458 includes toe-side sidewall 456 and toe-side outer edge 452. To form the dual, laterally spaced apart, longitudinal edges of the toe-side, DE snowboard includes toe-side inner edge 454. Toe-side lower step 474 is formed by the corner of toe-side inner edge 454. Likewise, because the inner portion of DE snowboard 400 is recessed, toe-side upper step 472 is formed at the interface between the inner portion of DE snowboard 400 and the toe-side offset 458.

A magnified portion of the heel-side lateral cross section 470 is illustrated in FIG. 4. Substantially symmetrical to the toe-side, the heel-side portion of DE snowboard 400 includes heel-side offset 468. Heel-side offset 468 includes heel-side outer upper layer 492, heel-side outer core 494, heel-side outer base 496, and heel-side sidewall 466. The heel-side also includes heel-side inner upper layer 482, heel-side inner core 484, and heel-side inner base 486. The dual edges on the heel-side are heel-side outer edge 462 and heel-side inner edge 464. Heel-side upper step 476 and heel-side lower step 478 are also shown in FIG. 4.

In contrast to the upwardly angled offsets of the embodiment illustrated FIG. 3, heel-side offset 468 and toe-side offset 458 are downwardly angled at an angle of θ with the horizontal. In some embodiments, θ is between 1° and 15°. The downward angle θ provides a lesser transition time between when the inner edge engages with the slope and when the outer edge engages with the slope, and also between when the outer edge disengages with the slope and when the inner edge disengages with the slope). This decrease in engagement/disengagement time results in different riding characteristics of DE snowboard 400. This transition time may be varied by the angle θ. In some embodiments, a larger downwardly sloping angle θ is chosen for riders that may need to engage the outer edges more frequently in moderate terrain. The angle creates a better edge grip on the snow and channels the snow under the board for better grip and floatation.

As illustrated in FIG. 4, in some embodiments, the outer edges are at a greater vertical height than the inner edges. In at least some embodiments, the outer and inner edges are at substantially similar heights. For these embodiments, the transition time between inner and outer edge engagement is very small and approaches simultaneous engagement of the inner and outer edges. Such arrangements may be employed for riders that may desire almost simultaneous engagement of two edges. Furthermore, such arrangements may be chosen for extremely steep and icy terrain, such as glacier routes. On such terrain, having simultaneous engagement of both inner and outer edges may provide enhanced edging capabilities, when the rider may otherwise be "edge-limited."

Figure 5:
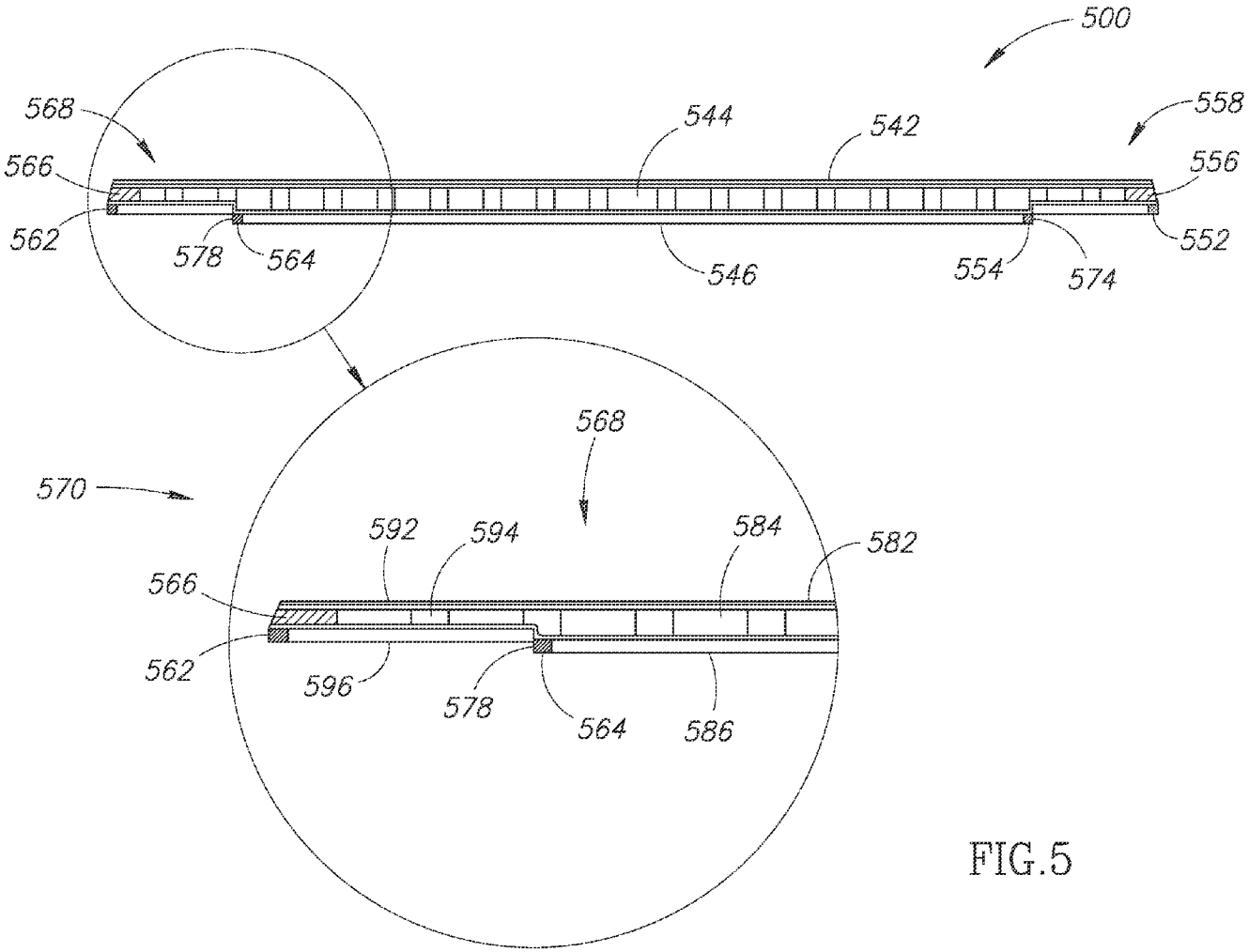
FIG. 5 illustrates a lateral cross section of a dual-edged snowboard that includes parallel lateral offsets and the cross-sectioned portion includes a non-recessed top surface, the snowboard being consistent with the various embodiments disclosed herein.

FIG. 5 illustrates a lateral cross section of DE snowboard 500 that includes parallel lateral offsets. The cross-sectioned portion includes a non-recessed inner top surface. DE snowboard 500 is consistent with the various embodiments disclosed herein. The lower portion of FIG. 5, which is within the larger of the two circular boundaries, illustrates a magnified portion of the heel-side lateral cross section 570 that is within the smaller circular boundary in the upper portion of FIG. 5.

Similar to the embodiments illustrated in FIG. 2, DE snowboard 500 includes an upper layer 542, a core 544, and a base 546. DE snowboard 500 also includes a heel-side offset 568 and a toe-side offset 558. Toe-side offset 558 includes toe-side sidewall 556 and toe-side outer edge 552. To form the dual, laterally spaced apart, longitudinal edges of the toe-side, toe-side inner edge 554 is included in DE snowboard 500. Toe-side lower step 574 is formed by the corner of toe-side inner edge 554.

A magnified portion of the heel-side lateral cross section 570 is illustrated in FIG. 5. Substantially symmetrical to the toe-side, the heel-side portion of DE snowboard 500 includes heel-side offset 568. Heel-side offset 568 includes heel-side outer upper layer 592, heel-side outer core 594, heel-side outer base 596, and heel-side sidewall 566. The heel-side also includes heel-side inner upper layer 582, heel-side inner core 584, and heel-side inner base 586. The dual edges on the heel-side are heel-side outer edge 562 and heel-side inner edge 564. Heel-side lower step 578 is also shown in FIG. 5.

Similar to the embodiment illustrated in FIG. 2, heel-side offset 568 and toe-side offset 558 are parallel offsets. However, in contrast to the embodiments shown in FIGS. 2, 3, and 4, the inner portion of DE snowboard 500 is not recessed relative to parallel heel-side offset 268 and parallel toe-side offset 558. Rather, the upper layer 542 is flush across the lateral width of DE snowboard. Accordingly, the inner portion of DE snowboard 500 is thicker than the thickness of both heel-side offset 568 and toe-side offset 558. In addition, the thickness of inner portion of DE snowboard 500 is thicker than the inner portions of the snowboards illustrated in FIGS. 2, 3, and 4, resulting in a stiffer snowboard. Alternatively, a board may include both recessed and non-recessed portions in differing regions of the board. For example, a board may have a non-recessed portion nearer the tip and tail, as these portions are less thick in most cases anyway. In these regions, the base offset may be small. As discussed in regards to FIGS. 10A and 10B, a recess may be filled with a substantially non-structural material to lift the surface, such as for a binding mount region.

In some embodiments, the thickness of the thicker inner portion of DE snowboard 500 is between 0.30 and 0.55 inches. In some embodiments, the thickness of heel-side offset 568 and toe-side offset 558 is between 0.15 and 0.25 inches. However, other embodiments are not so constrained.

Figure 6:
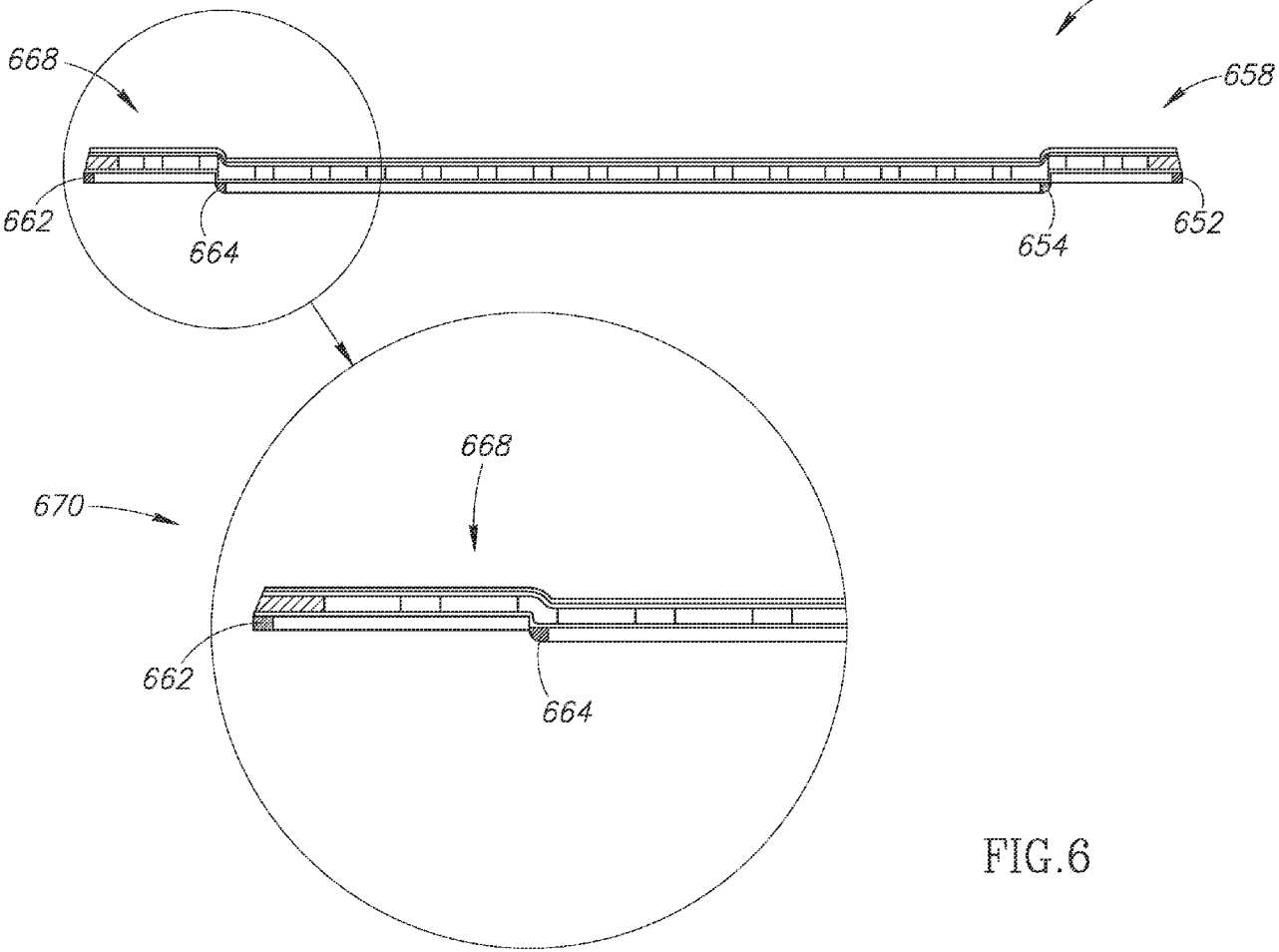
FIG. 6 illustrates a lateral cross section of a dual-edged snowboard that includes parallel lateral offsets, in which the inner edge is a rounded edge, the snowboard being consistent with the various embodiments disclosed herein.

FIG. 6 illustrates a lateral cross section of DE snowboard 600 that includes parallel lateral offsets. The cross-sectioned portion includes a recessed top surface and rounded inner edges. DE snowboard 600 is consistent with the various embodiments disclosed herein. The lower portion of FIG. 6, which is within the larger of the two circular boundaries, illustrates a magnified portion of the heel-side lateral cross section 670 that is within the smaller circular boundary in the upper portion of FIG. 6.

DE snowboard includes heel-side offset 668 and toe-side offset 658. Toe-side offset 658 includes toe-side outer edge 652 and toe-side inner edge 654. Heel-side offset 668 includes heel-side outer edge 662 and heel-side inner edge 664.

In some embodiments, at least one of the edges may be a rounded edge. In various embodiments, at least one of the edges may be a sharp edge. Rounded edges may provide less edging forces and less edging torques than sharp edges. DE snowboard 600 includes inner (transitional) edges 664 and 654 that are rounded edges. DE snowboard 600 also includes outer edges 662 and 652 that are sharp edges. Because the transitional edges are rounded, when the outer sharp edges engage with the snow or ice, a significant increase in the control and maneuverability of DE snowboard 600 is experienced by the rider. In at least one embodiment, rounded inner edges may reduce the likelihood of "catching" an inner edge, for example, on a manmade non-snow trick surface in a terrain park as discussed above.

Figure 7A:
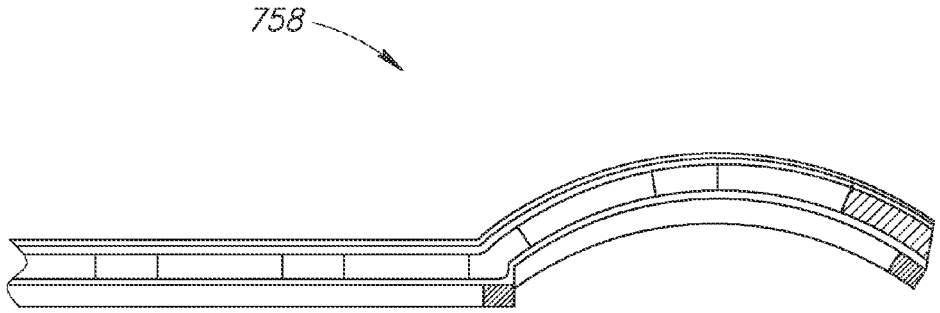
FIG. 7A illustrates a portion of a lateral cross section of a dual-edged snowboard that includes a lateral offset with a rounded base surface, the snowboard being consistent with the various embodiments disclosed herein.

FIG. 7A illustrates a portion of a lateral cross section of a DE snowboard 758 that includes a lateral offset with a rounded upper layer, core, and base surface, the snowboard being consistent with the various embodiments disclosed herein. The upwardly concaved shaped of the lateral offsets provided greater clearance of the offsets for when the board is ridden in terrain parks, pipes, and terrain dense with trees. Such a concave rounded lateral offset also provides good outer edge grip and snow channeling, while still providing easier turn initiation and center portion gliding. Because DE snowboard 758 is substantially symmetrical about its longitudinal axis, the portion displayed in FIG. 7A may be either a toe-side portion or a heel-side portion.

Figure 7B:
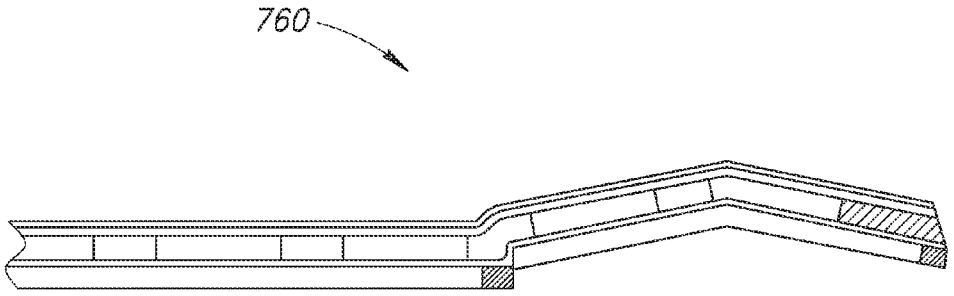
FIG. 7B illustrates a portion of a lateral cross section of a dual-edged snowboard that includes a lateral off et with angled surfaces, the snowboard being consistent with the various embodiments disclosed herein.

FIG. 7B illustrates a portion of a lateral cross section of a DE snowboard 760 that includes a lateral offset with angled surfaces, the snowboard being consistent with the various embodiments disclosed herein. The upwardly concave and angled shaped of the lateral offsets provided greater clearance of the offsets for when the board is ridden in terrain parks, pipes, and terrain dense with trees. Similar benefits accrue to the embodiment as with the rounded embodiment of FIG. 7A. However, with flat portions, turning may be easier. Because DE snowboard 760 is substantially symmetrical about its longitudinal axis, the portion displayed in FIG. 7B may be either a toe-side portion or a heel-side portion.

Figure 8A:
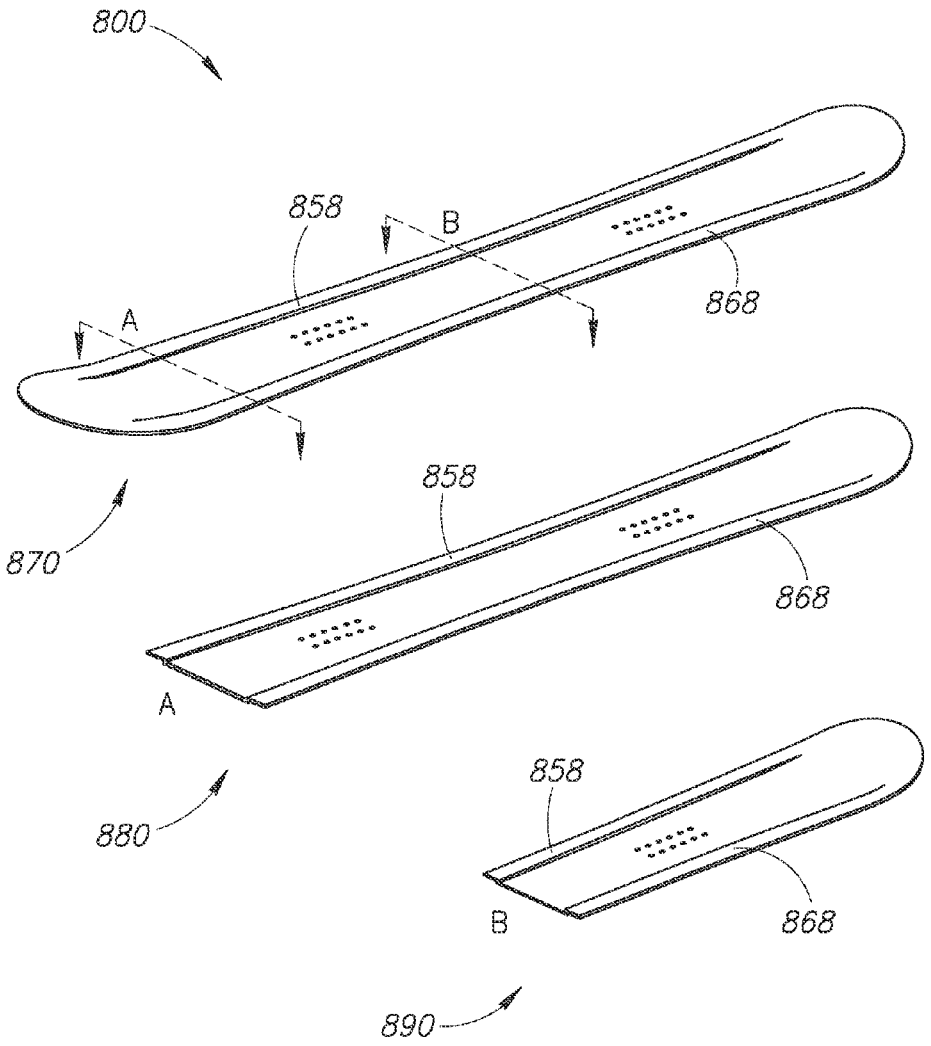
FIG. 8A illustrates various isometric views of a dual-edged snowboard where the binding regions on the top surface are recessed, the snowboard being consistent with the various embodiments disclosed herein.

FIG. 8A illustrates various isometric views of DE snowboard 800. DE snowboard 800 is also illustrated in the various orthographic views of FIG. 8B. DE snowboard 800 includes an inner region that includes a binding region and a waist region on the top surface. The inner region is recessed. DE snowboard 800 is consistent with the various embodiments disclosed herein.

Full isometric view 870 illustrates the entirety of the top surface of DE snowboard 800. Partial isometric view 880 illustrates a portion of the top surface of DE snowboard 800, where DE snowboard 800 has been laterally sliced at Location A. Location A is approximately where the tip of DE snowboard 800, such as tip 104 of FIG. 1, begins. Partial isometric view 880 also illustrates the lateral cross section of DE snowboard 800 at Location A.

Likewise, half-isometric view 890 illustrates a portion of the top surface of DE snowboard 800, where DE snowboard 800 has been laterally sliced at Location B. Location B is approximately at the waist region of DE snowboard 800, such as waist region 108 of FIG. 1. Half-isometric view 890 also illustrates the lateral cross section of DE snowboard 800 at Location B. In some embodiments, the lateral inner portion of DE snowboard 800 is thicker at Location A than it is in Location B. Preferably, the vertical offset gradually decreases towards the tip and tail of the board as the overall thickness of the board decreases. Other embodiments are not so constrained.

Lateral toe-side offset 858 and lateral heel-side offset 868 are parallel offsets, such as the parallel offsets of FIG. 2. However, other embodiments are not so constrained. Furthermore, the inner portion of DE snowboard 800 is recessed relative to these lateral offsets. The inner portion is recessed between the tip and the tail. The waist region and the binding region of DE snowboard 800 are recessed relative to toe-side offset 858 and heel-side offset 868. As discussed in regards to FIGS. 10A and 10B, in at least one embodiment, an insert, vertical spacer, shim, or a lift may be disposed intermediate the recessed binging region and the bindings to vertically displace the bindings upwards. This may be done so that the lower surface of a rider's snowboard boots are not at a vertical height less than the top surfaces of heel-side offset 858 and toe-side offset 868.

In some embodiments, the recessed inner portion of DE snowboard 800 includes up to 90% of the total surface area of the upper surface of DE snowboard 800. The total percentage of recessed surface area varies, depending upon the exact dimensions of the snowboard, including the widths of the toe-side offset 858 and the heel-side offset 868. In a preferred embodiment, the recessed portion is approximately 80% of the total surface area of the upper surface of DE snowboard 800. In other embodiments, the recessed portion is between 50% and 80% of the total surface area. In at least one embodiment, the recessed portion is as small as 40% of the total surface area.

Figure 8B:
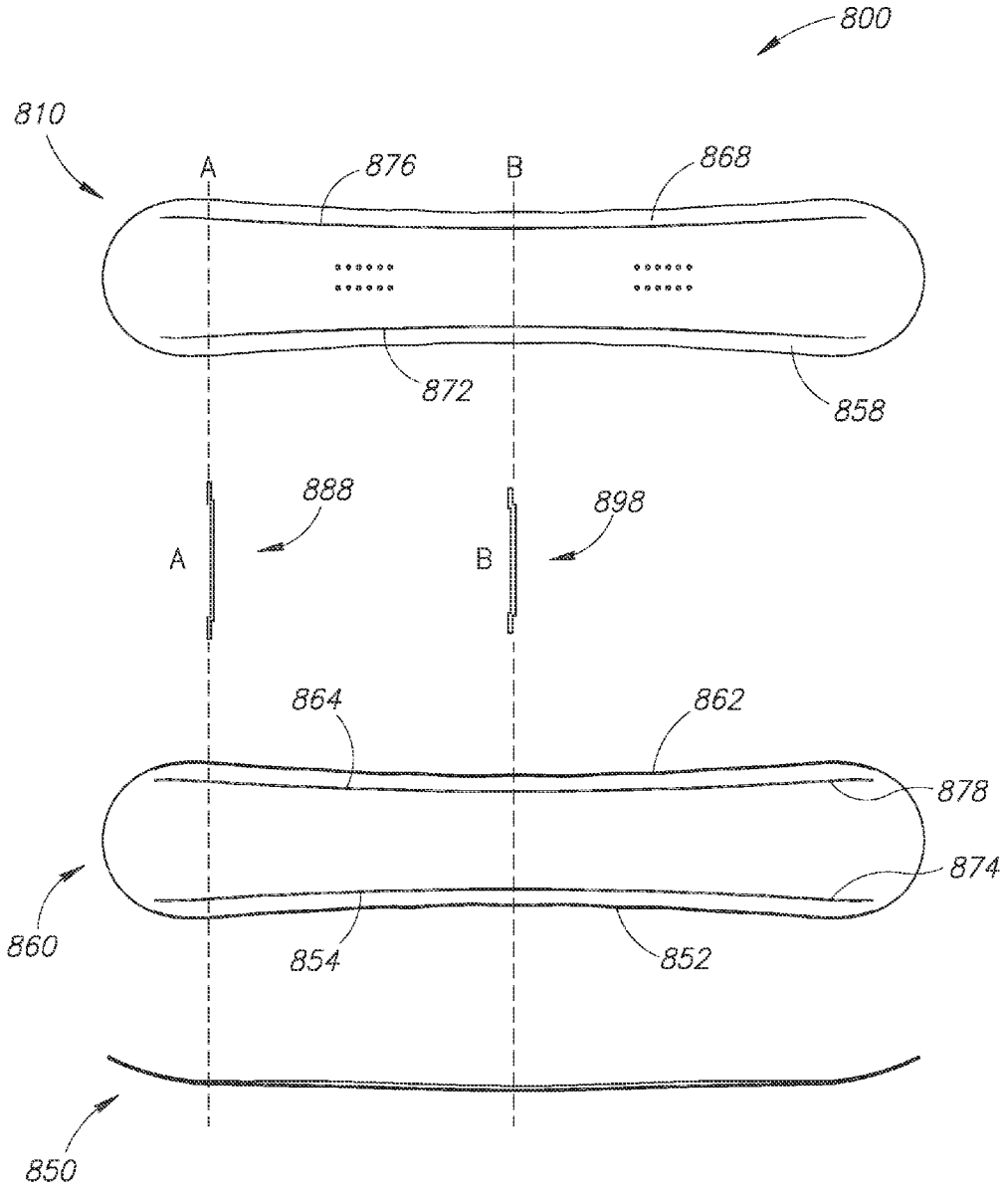
FIG. 8B illustrates various orthographic views of the dual-edged snowboard, illustrated in FIG. 8A, where the binding regions on the top surface are recessed, the snowboard being consistent with the various embodiments disclosed herein.

FIG. 8B illustrates various orthographic views of DE snowboard 800. DE snowboard 800 is also illustrated in the various isometric views of FIG. 8A. DE snowboard 800 includes a binding region and a waist region on the top surface that are recessed. DE snowboard 800 is consistent with the various embodiments disclosed herein.

Top view 810 illustrates the top surface of DE snowboard 800. Lateral toe-side offset 858 and lateral heel-side offset 868 are parallel offsets, such as the parallel offsets of FIG. 2. Toe-side upper step 872 and heel-side upper step 876 define the lateral boundaries of the recessed inner portion of DE snowboard 800. Cross section view 888 illustrates the lateral cross section of DE snowboard 800 at Location A. Cross section view 898 illustrates the lateral cross section of DE snowboard at Location B. Because the lateral offsets are parallel offsets and the inner portion DE snowboard is recessed, these cross sectional views are similar to the cross section view illustrated in FIG. 2. In at least one embodiment, the inner portion at the waist region is thicker than the inner portion at the tip and/or tail region.

Cross-sectional views 888 and 898 illustrate that, in at least some embodiments, DE snowboard 800 is corrugated on the top and base surfaces. This corrugation may result in a stiffer and/or less flexible snowboard. In at least one embodiment, the enhanced stiffness and/or decreased flexibility are at least partially compensated by one or more layers of fibers, such as fiberglass or basalt fibers, in DE snowboard 800 that are less stiff. In at least one embodiment, the enhanced stiffness and/or decreased flexibility are at least partially compensated by the use of paulownia wood in the core of in DE snowboard 800.

Bottom view 860 (FIG. 8B) illustrates the base surface of DE snowboard 800. The dual heel-side edges include heel-side outer edge 862 and heel-side inner edge 864. Likewise, the dual toe-side edges include toe-side outer edge 852 and toe-side inner edge 854. Heel-side lower step 878 and toe-side lower step 874 are also illustrated. In some embodiments, the heel-side/toe-side upper step is above the heel-side/toe-side lower step between the tip and tail of DE snowboard 800. Side view 850 illustrates that DE snowboard 800 includes a flat style camber profile, although the various embodiments are not so constrained and may include any other suitable camber profile.

Figure 9A:
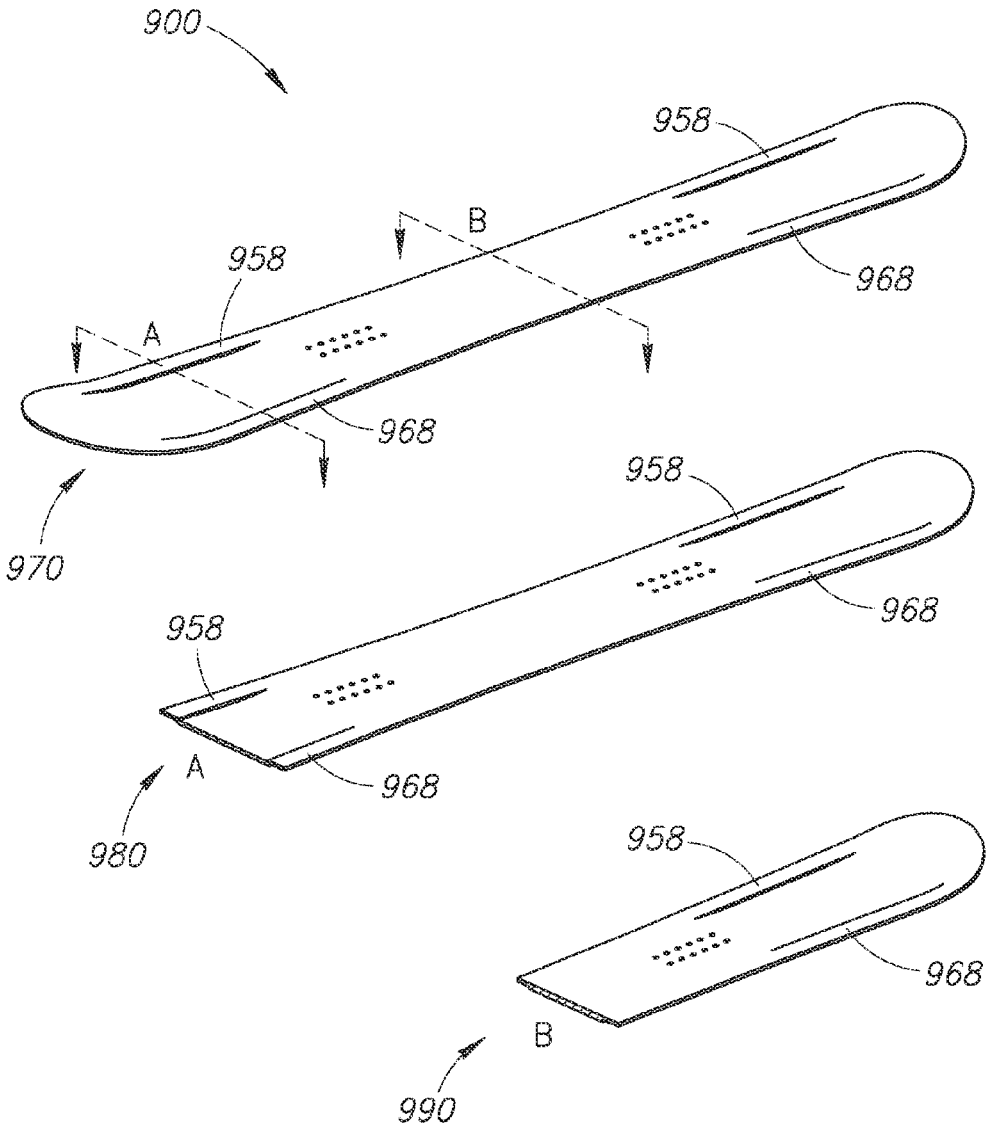
FIG. 9A illustrates isometric views of a dual-edged snowboard where the binding regions on the top surface are not recessed, the snowboard being consistent with the various embodiments disclosed herein.

FIG. 9A illustrates various isometric views of DE snowboard 900. DE snowboard 900 is also illustrated in the various orthographic views of FIG. 9B. DE snowboard 900 includes an inner region that includes a binding region and a waist region on the top surface that are not recessed. DE snowboard 800 is consistent with the various embodiments disclosed herein.

Full isometric view 970 illustrates the entirety of the top surface of DE snowboard 900. Partial isometric view 980 illustrates a portion of the top surface of DE snowboard 900, where DE snowboard 900 has been laterally sliced at Location A. Location A is approximately where a tip of DE snowboard 900, such as tip 104 of FIG. 1, begins. Partial isometric view 980 also illustrates the lateral cross section of DE snowboard 900 at Location A. In some embodiments, the inner portion of DE snowboard 900 is recessed at Location A, similar to the cross section illustrated in FIG. 2. Likewise, half-isometric view 990 illustrates a portion of the top surface of DE snowboard 900, where DE snowboard 900 has been laterally sliced at Location B. Location B is approximately at a waist region of DE snowboard 900, such as waist region 108 of FIG. 1. Half-isometric view 990 also illustrates the lateral cross section of DE snowboard 900 at Location B. In some embodiments, the inner portion of DE snowboard 900 is not recessed at Location B, similar to the cross section illustrated in FIG. 5.

Lateral toe-side offset 958 and lateral heel-side offset 968 are parallel offsets, such as the parallel offsets of FIG. 2 and FIG. 5. Although, other embodiments are not so constrained. Furthermore, portions of the inner portion of DE snowboard 900 are recessed relative to these lateral offsets, while other portions, are not recessed relative to the lateral offsets. For instance, the waist region and the binding region of DE snowboard 800 are not recessed relative to toe-side offset 958 and heel-side offset 968.

In some embodiments, the two recessed inner portions of DE snowboard 900 includes up to 60% of the total surface area of the upper surface of DE snowboard 900. The total percentage of recessed surface areas vary, depending upon the exact dimensions of the snowboard, including the widths of the toe-side offset 958 and the heel-side offset 968. In a preferred embodiment, the recessed portion is approximately 40% of the total surface area of the upper surface of DE snowboard 900. In other embodiments, the recessed portion is between 20% and 40% of the total surface area. In at least one embodiment, the recessed portion is as small as 15% of the total surface area.

Figure 9B:
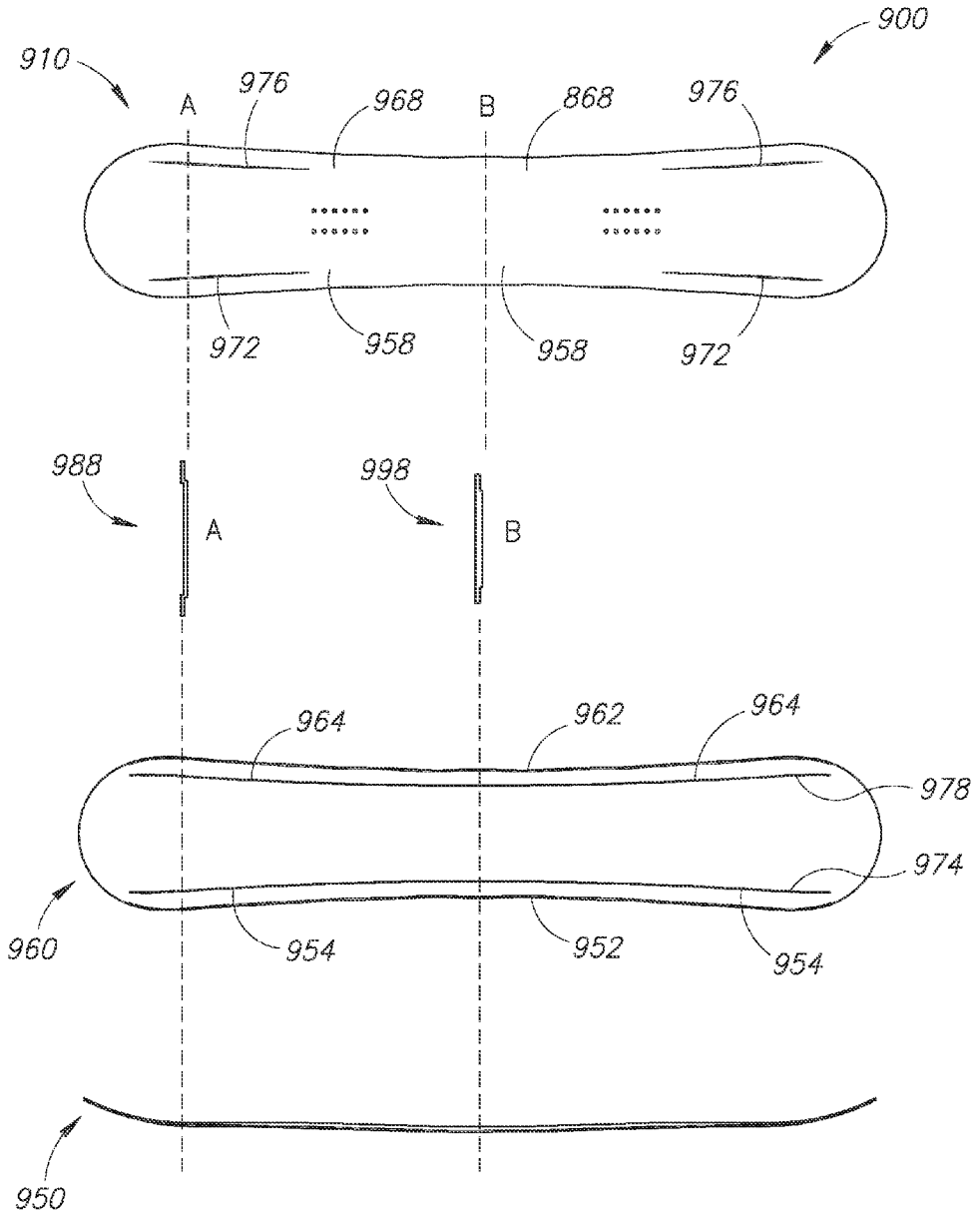
FIG. 9B illustrates various orthographic views of the dual-edged snowboard, illustrated in FIG. 9A, where the binding regions on the top surface are not recessed, the snowboard being consistent with the various embodiments disclosed herein.

FIG. 9B illustrates various orthographic views of DE snowboard 900. DE snowboard 900 is also illustrated in the various isometric views of FIG. 9A. DE snowboard 900 includes a binding region and a waist region on the top surface that are not recessed. DE snowboard 900 is consistent with the various embodiments disclosed herein.

Top view 910 illustrates the top surface of DE snowboard 900. Lateral toe-side offset 958 and lateral heel-side offset 968 are parallel offsets, such as the parallel offsets of FIG. 2 and FIG. 5. Toe-side upper step 972 and heel-side upper step 976 are shown. In some embodiment, the upper steps are longitudinally discontinuous because some portions of the inner portion of DE snowboard 900 are not recessed. For instance, the waist and binding regions of DE snowboard 900 are not recessed, while regions more proximate to the tip and tail are recessed.

Cross section view 988 illustrates the lateral cross section of DE snowboard at Location A. At Location A, the inner portion of DE snowboard 900 is recessed. Accordingly, cross section view 988 is similar to the cross section illustrated in FIG. 2.

Cross section view 998 illustrates the lateral cross section of DE snowboard 900 at Location B. At Location B, the inner portion of DE snowboard 900 is not recessed. Accordingly, the cross section view 998 is similar to the cross section illustrated in FIG. 5.

Cross sectional views 988 and 998 illustrates that, in at least some embodiments, DE snowboard 900 is somewhat corrugated on portions of the top surface and portions of the base surface. This corrugation may result in a stiffer and/or less flexible snowboard. In at least one embodiment, the enhanced stiffness and/or decreased flexibility are at least partially compensated by having regions on either the top or base surface that are not corrugated, such as the binding and waist regions of DE snowboard 900.

Bottom view 960 illustrates the base surface of DE snowboard 900. The dual heel-side edges include heel-side outer edge 962 and heel-side inner edge 964. Likewise, the dual toe-side edges include toe-side outer edge 952 and toe-side inner edge 954. Heel-side lower step 978 and toe-side lower step 974 are also illustrated.

As illustrated in FIG. 9B, in some embodiments, the inner edges and lower steps run longitudinally and substantially continuously between the tip and the tail regions. In other embodiments, the inner edges are not continuous. For instance, just as there may be inner portions on the top surface that are not recessed, in at least one embodiment, there are portions of the base that do not include inner edges. Likewise, in some embodiments, there are portions of the base that do not include outer edges. Side view 950 illustrates that DE snowboard 900 includes a flat style camber profile, although the various embodiments are not so constrained and may include any other suitable camber profile.

Figure 10A:
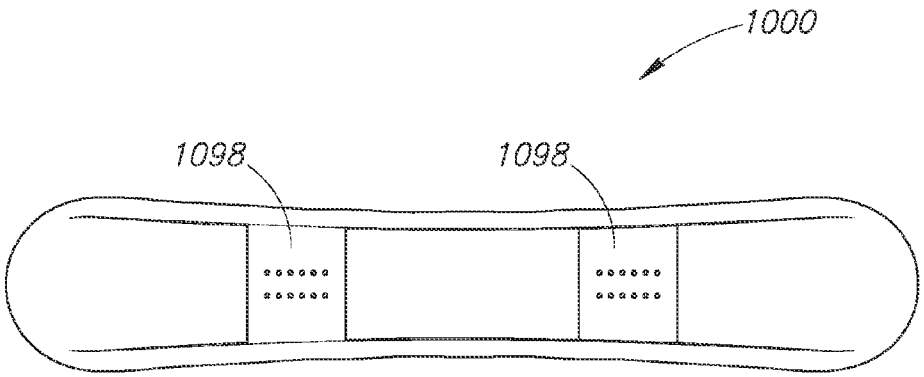
FIG. 10A illustrates a top view of a dual-edge snowboard where a portion of the top inner surface is recessed and spacers are employed so that the binding regions are not recessed, the snowboard being consistent with various embodiments disclosed herein.

FIG. 10A illustrates a top view of DE snowboard 1000 where a portion of the top inner surface is recessed and spacers are employed so that the binding regions are not recessed, DE snowboard 1000 being consistent with various embodiments disclosed herein. FIG. 10A illustrates DE snowboard 1000 in a similar manner to top view 810 of FIG. 8B. The construction of DE snowboard 1000 may be similar to DE snowboard 800 of FIGS. 8A and 8B, with the addition of spacers 1098.

DE snowboard 1000 includes two spacers 1098; one for each of recessed the binding regions. The spacers 1098 fill the gap above the binding regions such that the bindings are vertically displaced upwards. This may be done so that the lower surfaces of a rider's snowboard boots are not at a vertical height less than the top surfaces of lateral offsets. Spacers 1098 may be vertical spacers, shims, lifts, or other such gap filler structures.

In some embodiments, spacers 1098 are constructed from a material that is softer than other board materials, such as the upper structural layer 298 and lower structural layer 299 of FIG. 2. For example, spacers 1098 may be foam or plastic inserts. Accordingly, the use of spacers 1098 may not significantly affect the rigidity and/or flexibility of DE snowboard 1000. As shown in FIG. 10A, spacers 1098 are preferably isolated to the binding regions. However, other embodiments are not so constrained, and the spacers 1098 may be employed to fill the gaps associated with other recessed portions of the top surface of DE snowboard 1000.

In some embodiments, spacers 1098 are below a portion of the top sheet of DE snowboard 1000. However, in other embodiments, the spacers 1098 are added to DE snowboard 1000 after the top sheet has been laid over the top surface. Spacers 1098 may lift the binding mounting zone even with the non-recessed portion of the board or may even lift above the non-recessed portion.

Figure 10B:
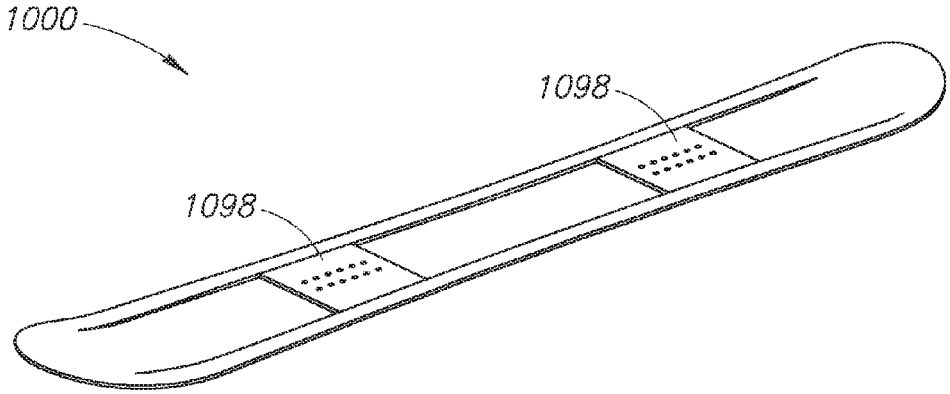
FIG. 10B illustrates an isometric view of a dual-edge snowboard where a portion of the top inner surface is recessed and spacers are employed so that the binding regions are not recessed, the snowboard being consistent with various embodiments disclosed herein.

FIG. 10B illustrates an isometric view of DE snowboard 1000 where a portion of the top inner surface is recessed and spacers 1098 are employed so that the binding regions are not recessed, the snowboard being consistent with various embodiments disclosed herein. FIG. 10B illustrates DE snowboard 1000 in a similar manner to top view 870 of FIG. 8A.

Figure 10C:
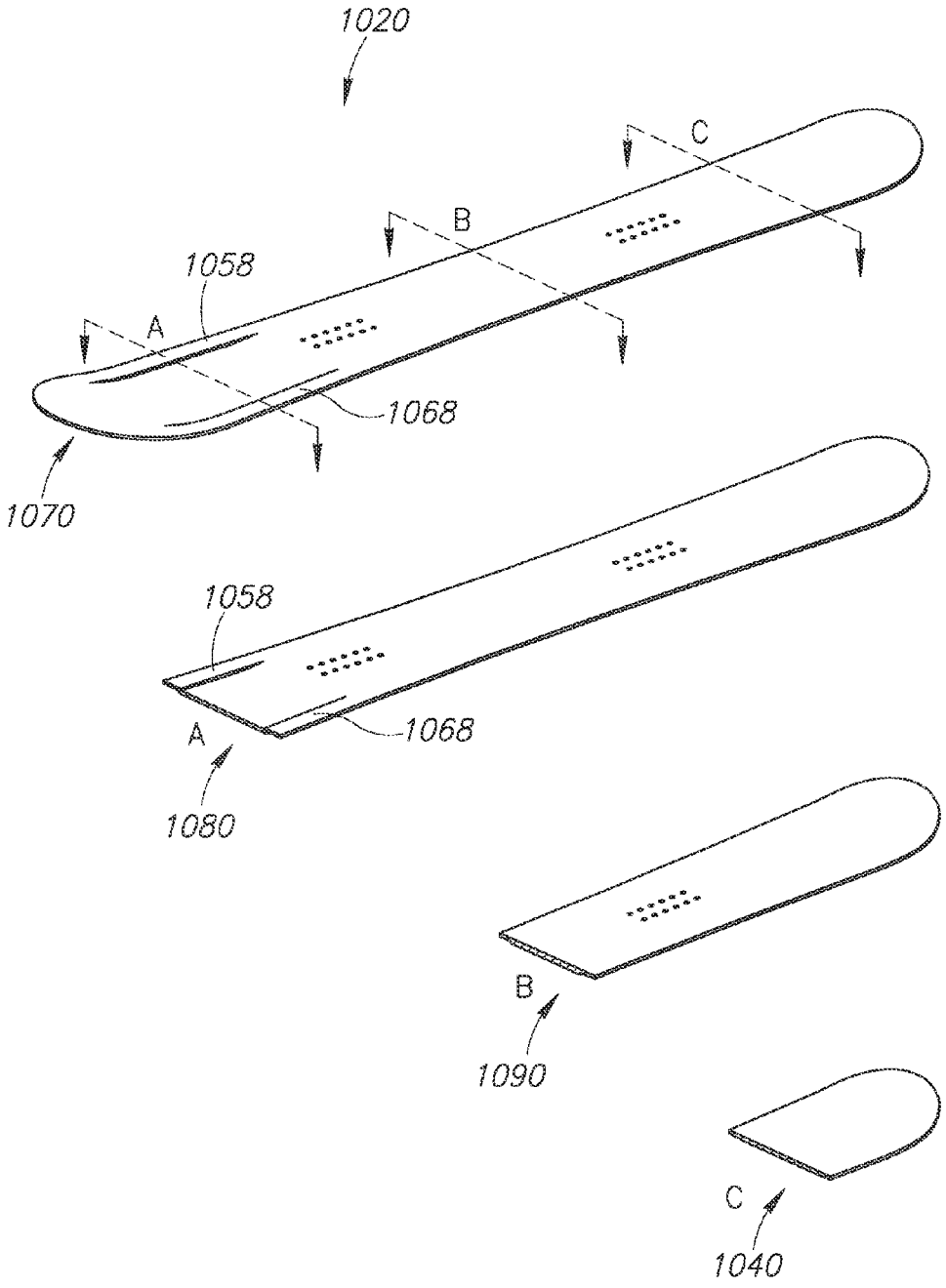
FIG. 10C illustrates a top view of a directional dual-edge snowboard where one of the longitudinal halves of the snowboard includes a dual-edge and the other longitudinal half includes a single edge, the snowboard being consistent with various embodiments disclosed herein.

FIG. 10C illustrates a top view of a directional DE snowboard 1020 where one of the longitudinal halves of DE snowboard 1020 includes a dual-edge and the other longitudinal half includes a single edge, DE snowboard 1020 being consistent with various embodiments disclosed herein. In a preferred embodiment, the single edge is a continuation of the outer edge of the dual edged portion of the directional DE snowboard 1020.

In some embodiments, directional DE snowboard 1020 is similar to DE snowboard 900 illustrated in FIGS. 9A and 9B, with the exception that the dual edges are employed on only one of the two longitudinal ends (tail or tip) of the snowboard. In a preferred embodiment, the tail end of directional DE snowboard 1020 includes dual edges and the tip end includes a single edge. In such an embodiment, the uphill portion (i.e., the rearward portion) of directional DE snowboard 1020 includes dual edges, while the generally downhill portion (i.e., the forward portion) includes traditional single edges. In an alternative embodiment, the tip end of directional DE snowboard 1020 includes dual edges, and the tail end includes a single edge.

Full isometric view 1070 of FIG. 10C illustrates the entirety of the top surface of directional DE snowboard 1020. Full isometric view 1070 is similar to full isometric view 970, of DE snowboard 900, of FIG. 9A, except the upper steps and recessed portions of the upper surface on are only one of the longitudinal halves of directional DE snowboard 1020.

Partial isometric view 1080 illustrates a portion of the top surface of directional DE snowboard 1020, where DE snowboard 1020 has been laterally sliced at Location A. Partial isometric view 1080 is similar to partial isometric view 980, of DE snowboard 900, of FIG. 9A. Location A, of partial isometric view 1080, is approximately where the tail (or tip) of directional DE snowboard 1020 begins. Partial isometric view 1080 also illustrates the lateral cross section of DE snowboard 1020 at Location A.

Likewise, half-isometric view 1090 illustrates a portion of the top surface of directional DE snowboard 1020, where DE snowboard 1020 has been laterally sliced at Location B. Half-isometric view 1090 is similar to half-isometric view 990, of DE snowboard 900, of FIG. 9A. Location B, of half-isometric view 1090, is approximately at the waist region of directional DE snowboard 1020. Half-isometric view 1090 also illustrates the lateral cross section of directional DE snowboard 1020 at Location B.

Quarter isometric view 1040 illustrates a portion of the top surface of directional DE snowboard 1020, where DE snowboard 1020 has been laterally sliced at Location C. Location C is approximately where the tip (or tail) of DE snowboard 1020 begin. Partial isometric view 1040 also illustrates the lateral cross section of DE snowboard 1020 at Location C.

Directional DE snowboard 1020 includes toe-side offset 1058 and lateral heel-side offset 1068 (or vice-versa depending on if the rider's stance is regular or "goofy"). In the embodiment illustrated in FIG. 10C, the portions of the upper surface that are recessed relative to the lateral offsets are limited to the inner portion of directional DE snowboard 1020 between the tail (or tip) and the nearer of the two binding regions. Other embodiments are not so constrained, and the recessed portions may include portions closer to the waist region.

The lateral cross sections at Location A and Location B, illustrated in views 1080 and 1090 respectively, show the dual-edge structure between the tail (or tip) and the waist region is similar to that of DE snowboard 900 of FIGS. 9A and 9B. The lateral cross at Location C, illustrated in view 1040, substantially resembles the lateral cross section of a traditional single-edge snowboard. The region between the waist and the tip (or tail) includes a traditional snowboard single-edge structure. By including a dual edge structure on only one of the longitudinal halves of direction DE snowboard 1020, an increase in stiffness or loss of flexibility of the board from any included corrugation structures is decreased while retaining many advantages of the dual-edge structure.

Figure 10D:
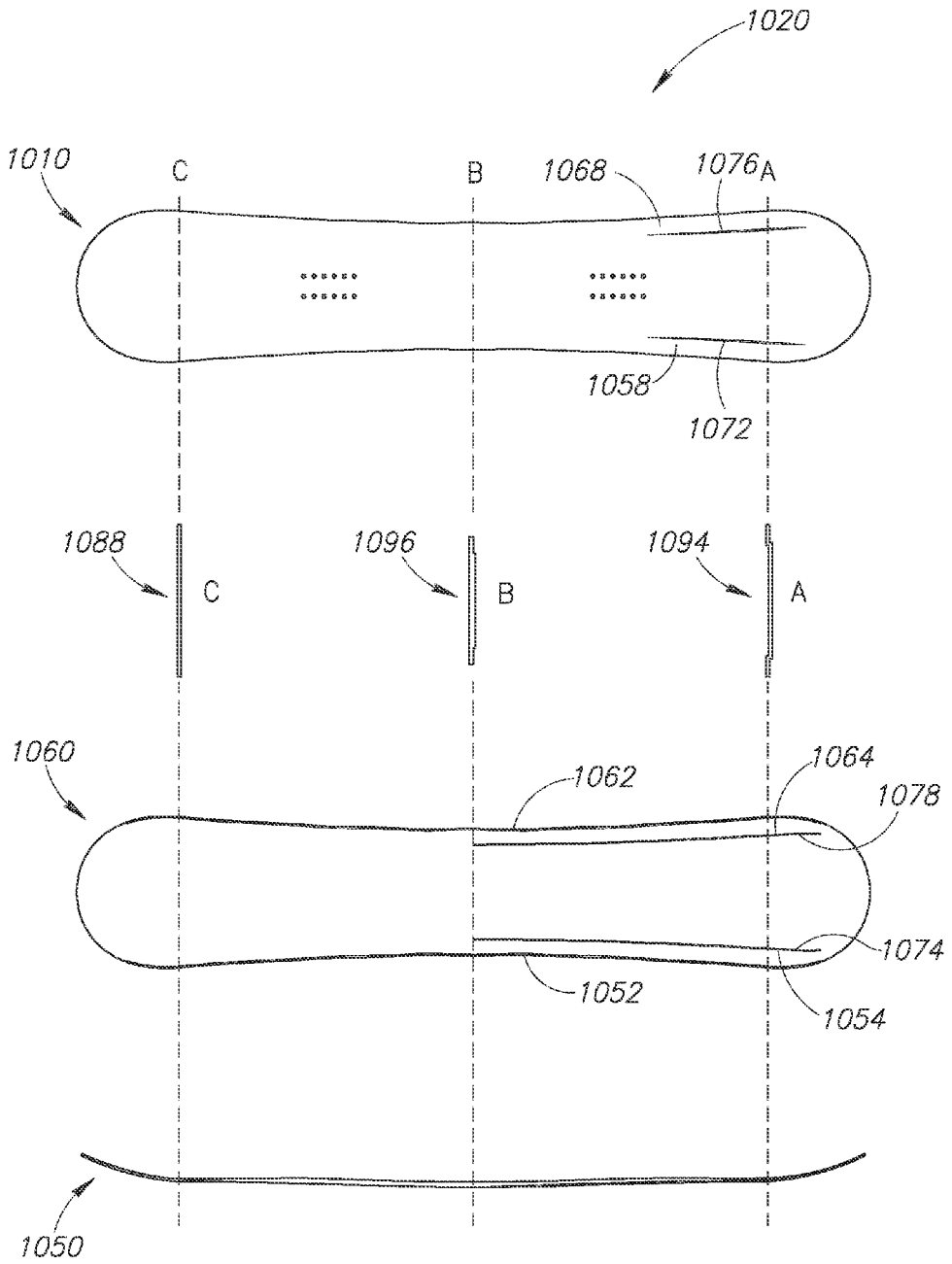
FIG. 10D illustrates an isometric view of a directional dual-edge snowboard where one of the longitudinal halves of the snowboard includes a dual-edge and the other longitudinal half includes a single edge, the snowboard being consistent with various embodiments disclosed herein.

FIG. 10D illustrates an isometric view of directional DE snowboard 1020 where one of the longitudinal halves of the snowboard includes a dual-edge structure and the other longitudinal half includes a single-edge structure, directional DE snowboard 1020 being consistent with various embodiments disclosed herein.

Top view 1010 illustrates the top surface of directional DE snowboard 1020. Lateral toe-side offset 1058 and lateral heel-side offset 1068 are parallel offsets, however other embodiments are not so constrained and other offset structures may be employed. Toe-side upper step 1072 and heel-side upper step 1076 are shown in top view 1010. In contrast to DE snowboard 900 of FIGS. 9A and 9B, the upper steps of directional DE snowboard 1020, which define a recessed portion of the upper surface, are included on only one of the longitudinal ends or halves of the board.

Cross section view 1094 of FIG. 10D illustrates the lateral cross section of DE snowboard at Location A. At Location A, the upper inner portion of directional DE snowboard 1020 is recessed and the bottom surface includes dual edges; an outer edge and an inner edge. Accordingly, cross section view 1094 is similar to the cross section 988 of FIG. 9B.

Cross section view 1096 illustrates the lateral cross section of directional DE snowboard 1020 at Location B. At Location B, the upper inner portion of directional DE snowboard 1020 is not recessed and the bottom surface includes a dual-edge structure. Accordingly, the cross section view 1096 is similar to the cross section 998 of FIG. 9B.

Cross section view 1088 illustrates the lateral cross section of DE snowboard at Location C. At Location C, the upper inner portion of directional DE snowboard 1020 is not recessed and the bottom surface includes a single-edge structure: the outer edge. Thus, the lateral cross section view of 1088 resembles a traditional single-edge snowboard.

A comparison of the lateral cross sections of directional DE snowboard 1020, illustrated in views 1088, 1096, 1094, with the lateral cross sections of DE snowboard 900, illustrated in views 988 and 998, shows that, in at least some embodiments, the amount of directional DE snowboard 1020 that is corrugated may be decreased. This decrease in corrugation enables the construction of a more flexible snowboard that retains the advantages of the dual-edged structure.

Bottom view 1060 illustrates the base, or bottom, surface of directional DE snowboard 1020. The dual-edge structure is located on only one longitudinal half, or end, of directional DE snowboard 1020. In some embodiments, the dual edges are employed intermediate the tail (or tip) region and the waist region. In some embodiments, the dual edges extend slightly beyond the longitudinal midpoint of directional DE snowboard 1020 into the other longitudinal half. In other embodiments, the dual edges extend to almost the longitudinal midpoint so slightly less than one half of the longitudinal length of directional DE snowboard 1020 includes the dual-edge structure. In a preferred embodiment, the dual edges extend between the tail (or tip) region to the longitudinal midpoint of directional DE snowboard 1020, as illustrated in bottom view 1060.

The dual heel-side edges include heel-side outer edge 1062 and heel-side inner edge 1064. The heel-side outer edge 1062 extends along the longitudinal length of the heel-side and is included in both longitudinal halves of directional DE snowboard 1020. The heel-side inner edge 1064 extends only between the tail (or tip) region to the waist or longitudinal midpoint and is thus included in only the half of that included the dual-edge structure.

Likewise, the dual toe-side edges include toe-side outer edge 1052 and toe-side inner edge 1054. The toe-side outer edge 1052 extends along the longitudinal length of the toe-side of directional DE snowboard 1020. The toe-side inner edge 1054 extends only between the tail (or tip) region to the waist or longitudinal midpoint. Heel-side lower step 1078 and toe-side lower step 1074 are also illustrated. Note that the lower steps only extend along the length of the inner edges. Side view 1050 illustrates that directional DE snowboard 1020 includes a flat style camber profile, although the various embodiments are not so constrained and may include any other suitable camber profile.

Figure 11:
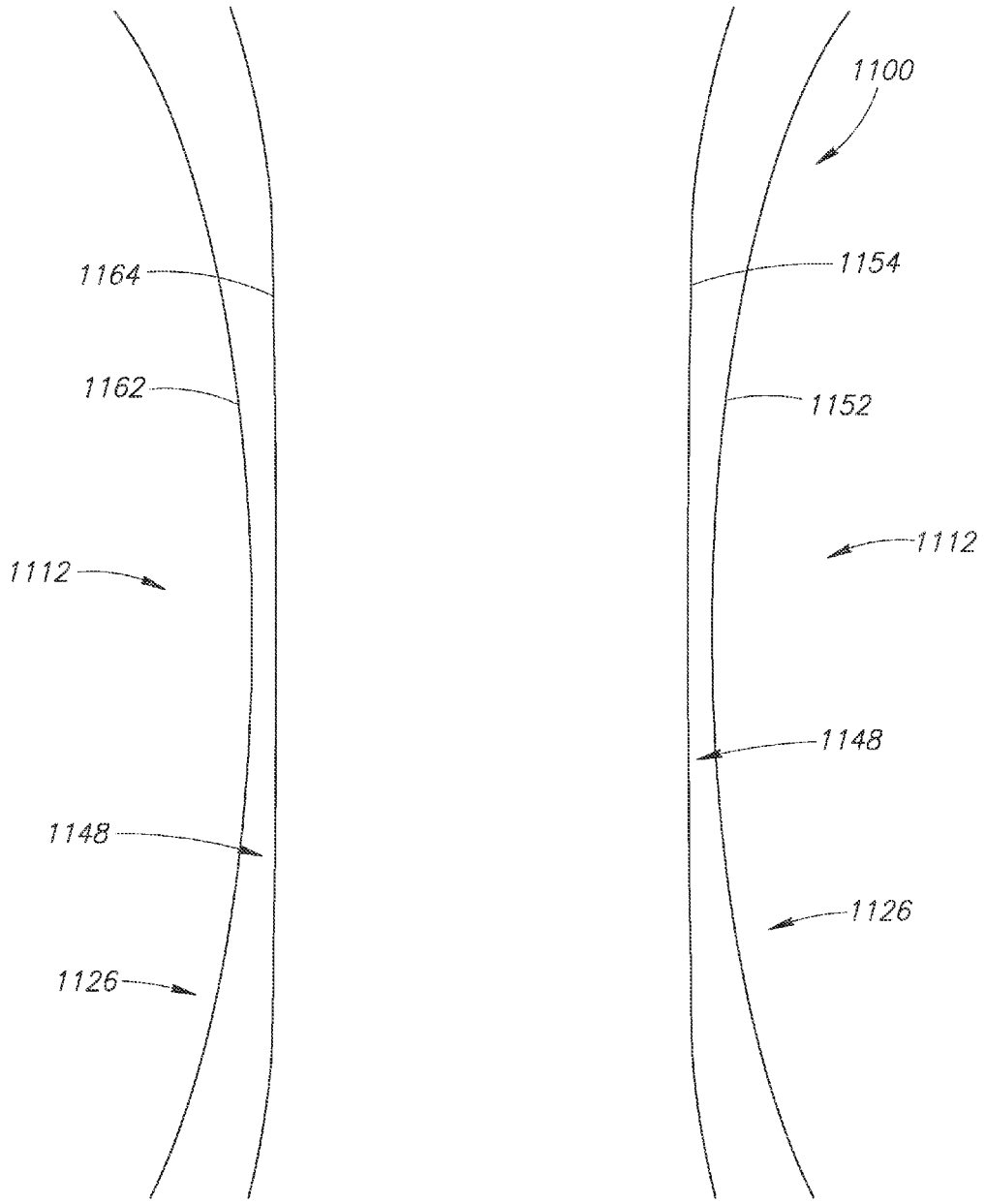
FIG. 11 illustrates the base of a dual-edged snowboard, under the waist region, where the inner side cut has a larger radius of curvature than the outer side cut, the snowboard being consistent with the various embodiments disclosed herein.

FIG. 11 illustrates the base of a DE snowboard 1100, under the waist region, where the inner side cut has a larger radius of curvature than the outer side cut, the snowboard being consistent with the various embodiments disclosed herein.

DE snowboard 1100 includes heel-side inner edge 1164, heel-side outer edge 1164, toe-side inner edge 1154, and toe-side outer edge 1152. Concave sidecuts 1112 for both the inner and outer edges are shown. Heel-side inner edge 1164 and toe-side inner edge 1154 are defined by a first radius of curvature 1148. Likewise, heel-side outer edge 1162 and toe-side outer edge 1152 are defined by a second radius of curvature 1126.

In a preferred embodiment, the first radius of curvature 1148 is greater than the second radius of curvature 1126. A smaller radius of curvature generally allows for tighter turns when the edge engages with the snow. A larger radius of curvature is generally more stable at high speed and allows for more floatation in powder terrain.

In embodiments that include an outer edge sidecut radius that is less than the inner edge sidecut radius of curvature, DE snowboard 1000 provides a progressive radius of curvature. When the rider initiates a turn on the inner edge, the edge with the larger sidecut radius of curvature edge first engages with the snow. As the rider more aggressively engages the snowboard throughout the turn, the edge with the smaller sidecut radius of curvature engages with the snow. When the outer edge engages the snow surface, the radius of the turn is tightened. Thus, when the rider only needs turns of a wide radius, the rider need only engage the inner edges. Furthermore, when the rider is gliding substantially flat on the base, the edges tend to catch less and do not hinder the smooth, fast running of the board. However, when the rider desires to or the terrain requires, the rider can engage the outer edge to tighten the turn.

In some embodiments, the first radius of curvature 1148 is between 7.5 and 10.0 meters. The second radius of curvature 1126 may be between 6.5 and 9.0 meters. In at least one embodiment, the first radius of curvature 1148 is equal to the second radius of curvature 1126. In an alternative embodiment, the first radius of curvature 1148 is less than the second radius of curvature 1126.

Figure 12A:
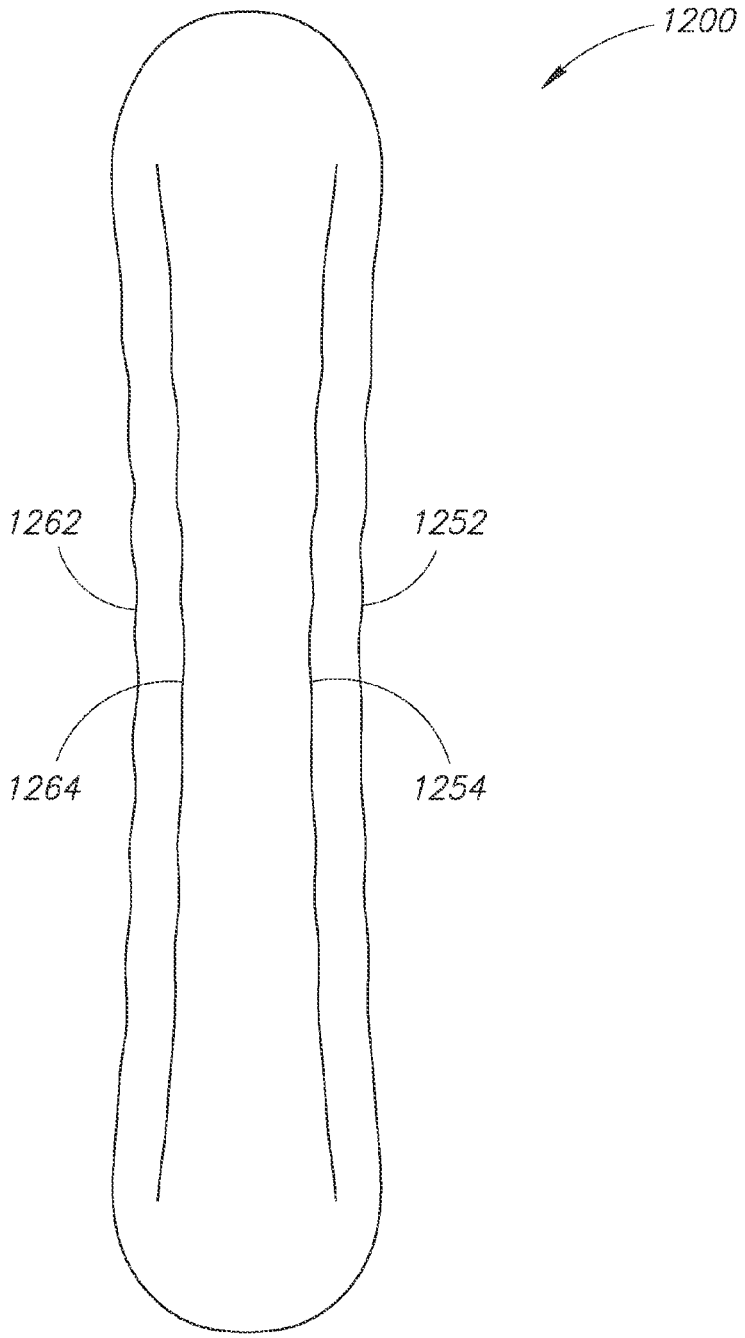
FIG. 12A illustrates the base surface of a snowboard where both the inner and outer edges include serrated edges, the snowboard being consistent with the various embodiments disclosed herein.

FIG. 12A illustrates the base surface of DE snowboard 1200 where both the inner and outer edges are serrated edges. DE snowboard 1200 being consistent with the various embodiments disclosed herein. DE snowboard 1200 includes heel-side outer edge 1262, heel-side inner edge 1264, toe-side outer edge 1252, and toe-side inner edge 1254. Each of these edges is a serrated edge.

In some embodiments, a serrated edge includes one or more bumps, serrations, or wavy curves along the longitudinal length of a sidecut, where the edge is specifically sized and located to improve edge hold and focus the control of DE snowboard 1200. In a preferred embodiment, each serrated edge includes seven bumps or serrations, although some embodiments may contain more or less. In a preferred embodiment, the three largest and most aggressive serrations are located between the rider's feet. This adds control to the waist region, where the rider's center-of-mass is located. Smaller and less aggressive serrations are located between the rider's front foot and the tip. Likewise, smaller and less aggressive serrations may be located between the rider's back foot and the tail.

Figure 12B:
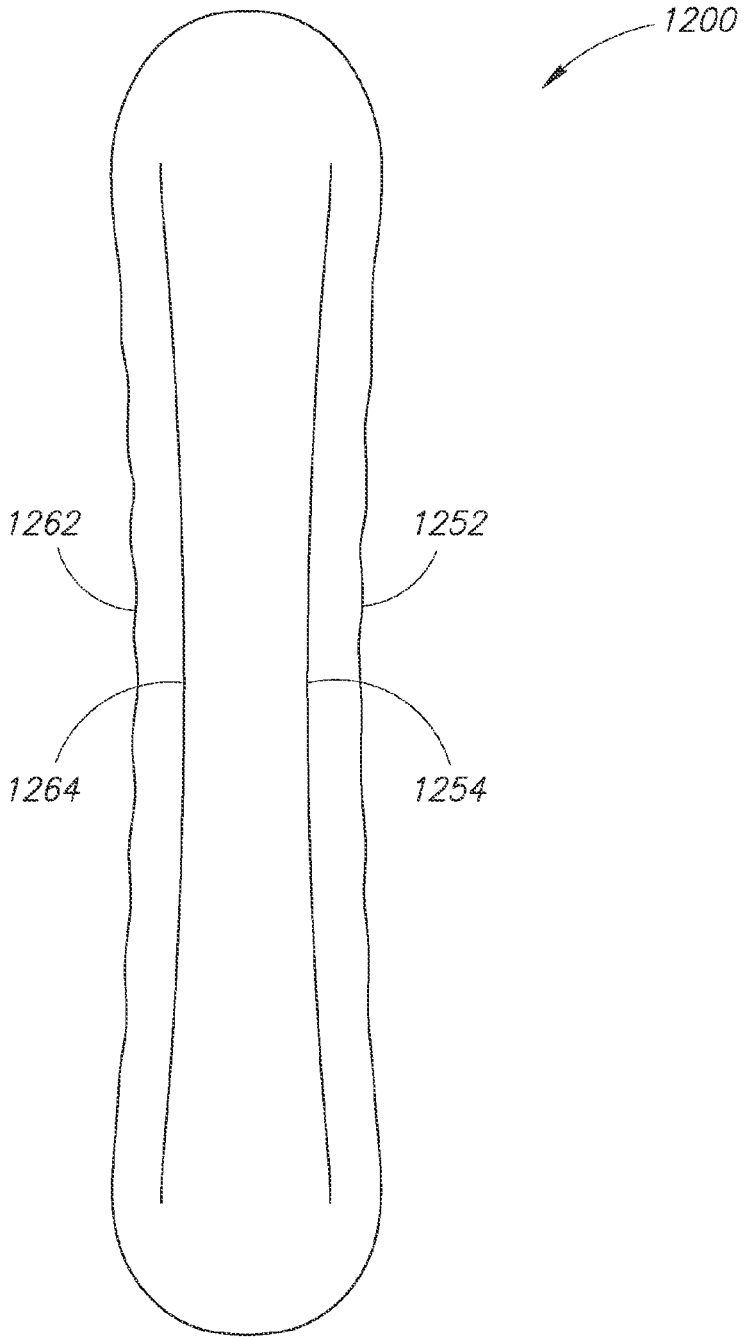
FIG. 12B illustrates the base surface of a snowboard where the outer edges include serrated edges and the inner edges do not include serrated edges, the snowboard being consistent with the various embodiments disclosed herein.

As illustrated in FIG. 12A, in some embodiments, each of the inner and outer edges is a serrated edge. In other embodiments, as shown in FIG. 12B, only the outer edges are serrated edges. In still other embodiments, only the inner edges are serrated edges. In at least one embodiment, a serrated edge is a Magne-Traction® wavy edge.

FIG. 12B illustrates the base surface of DE snowboard 1200 where the outer edges include serrated edges but the inner edges do not include serrated edges, DE snowboard 1200 being consistent with the various embodiments disclosed herein. DE snowboard 1200 includes heel-side outer edge 1262, heel-side inner edge 1264, toe-side outer edge 1252, and toe-side inner edge 1254.

Note that each of heel-side outer edge 1262 and toe-side outer edge 1252 are serrated edges. Also, note that each of heel-side inner edge 1264 and toe-side inner edge 1254 are not serrated edges. The non-serrated edges allow for a smooth glide along the snow surface and the serrated edges enable superior edge hold. Accordingly, depending on terrain, conditions, and other such factors, the rider may selectively employ either the inner or the outer edges throughout a turn to negotiate the terrain.

Figure 13:
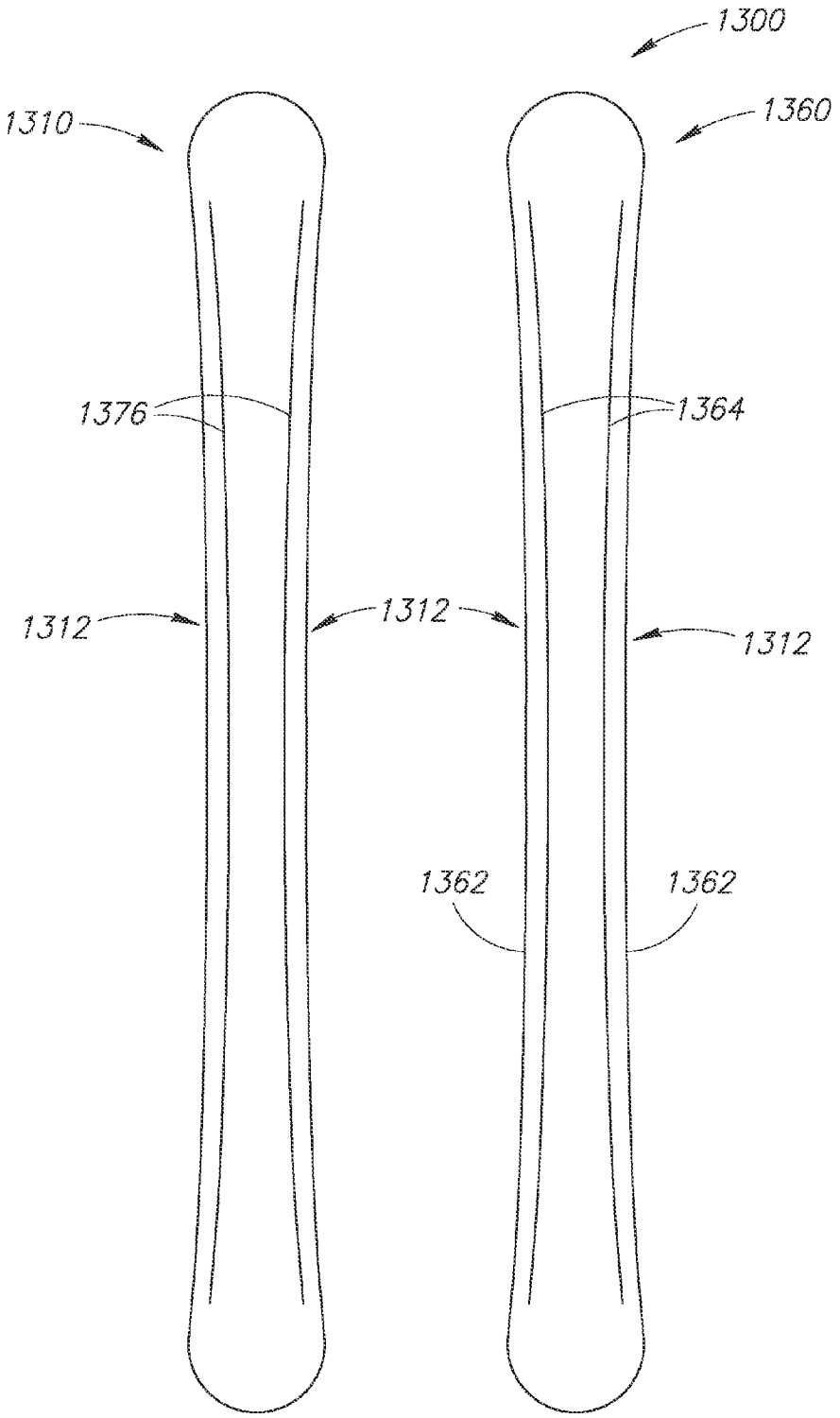
FIG. 13 illustrates a dual-edge snow ski that is consistent with the various embodiments disclosed herein.

FIG. 13 illustrates DE snow ski 1300 that is consistent with the various embodiments disclosed herein. Top view 1310 illustrates the upper layer of DE ski 1300. DE ski 1300 includes upper step 1376 and sidecuts 1312. Bottom view 1360 illustrates inner edges 1364 and outer edges 1362. As used herein, a snow ski may include, but is not limited to, downhill skis, telemark skis, backcountry skis, mono skis, and the like.

Figure 14A:
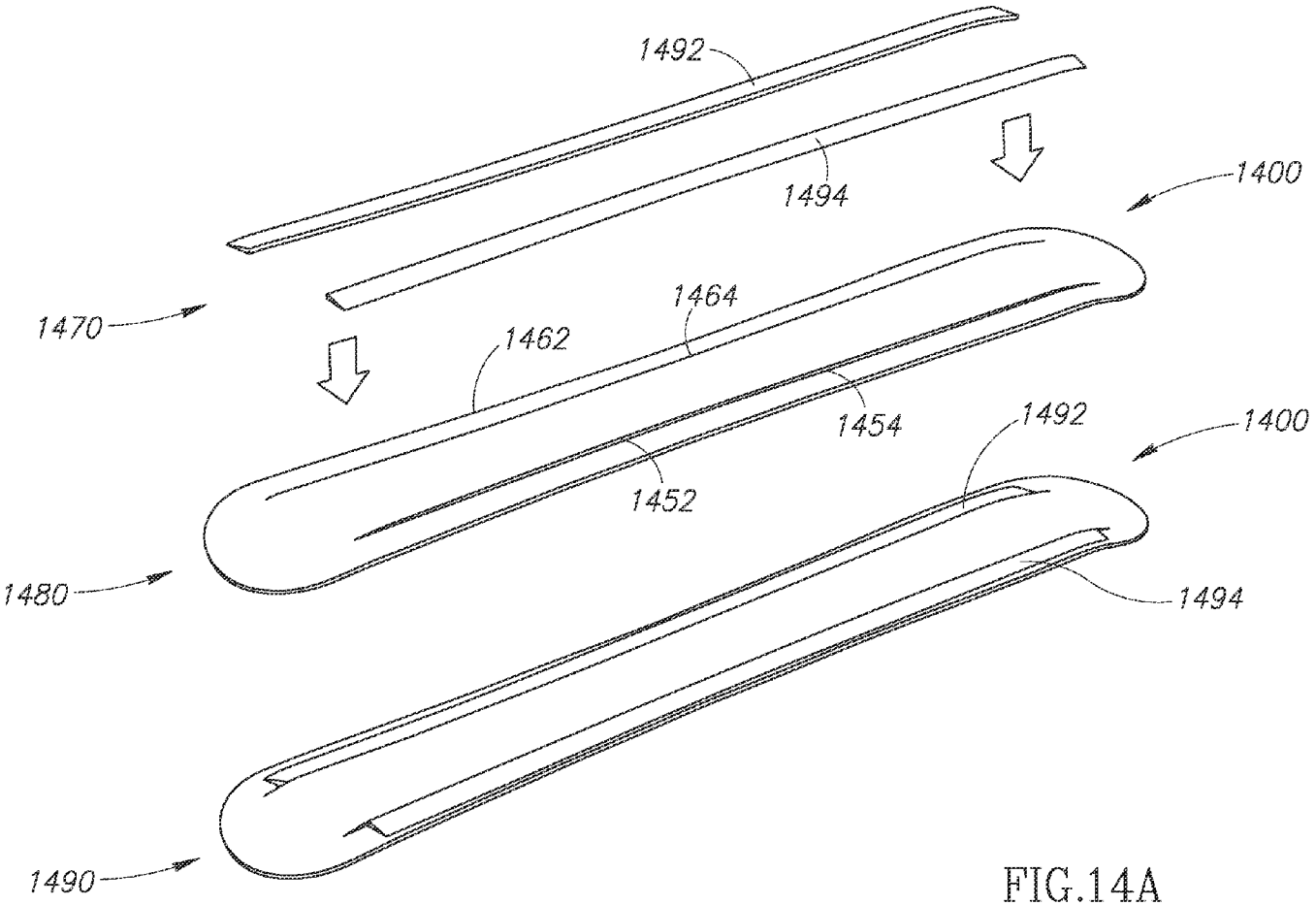
FIG. 14A illustrates a pair of adjustable outer edge accessories and a dual-edge snowboard, where the adjustable outer edge accessories provide the dual-edge snowboard an adjustable outer edge.

FIG. 14A illustrates a pair of adjustable outer edge accessories and a dual-edge snowboard, where the adjustable outer edge accessories provide the dual-edge snowboard an adjustable outer edge. View 1470 shows heel-side adjustable outer edge accessory 1492 and toe-side adjustable outer edge accessory 1494. In a preferred embodiment, the construction of the adjustable outer edge accessories are symmetric, although other embodiments are not so constrained. The adjustable outer edge accessories are wedge-shaped and have a longitudinal length that substantially matches the longitudinal length of the inner edges of a DE snowboard, such as DE snowboard 1400 of view 1480.

View 1480 of FIG. 14A shows DE snowboard 1400 that includes heel-side inner edge 1464, heel-side outer edge 1462, toe-side inner edge 1454, and toe-side outer edge 1452. DE snowboard 1400 is consistent with the various embodiments described herein. View 1490 shows heel-side adjustable outer edge accessory 1492 and toe-side adjustable outer edge accessory 1494 integrated with DE snowboard 1400. Each of the adjustable outer edge accessories is longitudinally aligned with the corresponding inner and outer edges of DE snowboard 1400. Taken together, views 1470 and 1480 illustrate an exploded view of the DE snowboard 1400 and adjustable outer edge accessories integrated system shown in view 1490.

In some embodiments, the adjustable outer edge accessories are coupled to DE snowboard 1400 by any combination of fasteners such as rivets, screws, bolts, and the like. In some embodiments, the adjustable outer edge accessories are at least partially coupled to DE snowboard 1400 with the use of an adhesive, such as epoxy. In various embodiments, the adjustable outer edge accessories are removably coupled to DE snowboard 1400. In at least one embodiment, the adjustable outer edge accessories are not removable from DE snowboard 1400, but are rather integral components of DE snowboard 1400.

Figure 14B:
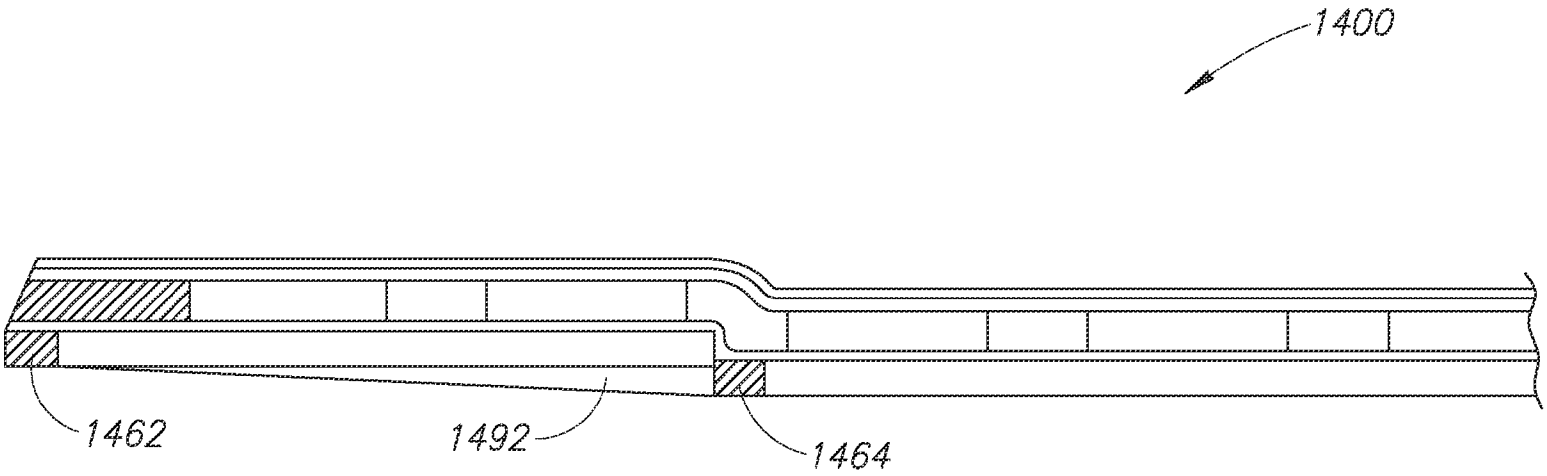
FIG. 14B illustrates a lateral cross section of the dual-edged snowboard and one of the adjustable outer edge accessories of FIG. 14A.

FIG. 14B illustrates a lateral cross section of the dual-edged snowboard and one of the adjustable outer edge accessories of FIG. 14A. Heel-side adjustable outer edge accessory 1492 is integrated with DE snowboard 1400, as shown in view 1490 of FIG. 14A. FIG. 14B shows a similar view to that of the close-up view of the lateral cross section of DE snowboard 200 of FIG. 2, with the addition of the integration of heel-side outer edge accessory 1492. Heel-side inner edge 1464 and heel-side outer edge 1462 of DE snowboard 1400 are shown in FIG. 14B.

As shown in FIG. 14B, the angled or sloping nature of the underside of heel-side outer adjustable edge 1492 provides a continuous slope between heel-side inner edge 1464 and heel-side outer edge 1462. This enables a rider to smoothly transition between the inner and outer edges when riding DE snowboard 1400. For instance, when initiating a carve or turn, a rider transitions from heel-side inner edge 1464 to heel-side outer edge 1462. During this transition, the underside of the heel-side outer edge adjustment remains in contact with the snow allowing for an adjustable outer edge transition. Because the rider can control the smooth transition between the inner and outer edge, the rider has the ability to control the engagement of the outer edge, as compared to binary inner edge/outer edge transition.

While the preferred embodiments of the invention have been illustrated and described, as noted above, many changes can be made without departing from the spirit and scope of the invention. Accordingly, the scope of the invention is not limited by the disclosure of the preferred embodiments. Instead, the invention should be determined entirely by reference to the claims that follow.

The invention claimed is:

1. A deck configured and arranged for gliding on a surface, the deck comprising:

an inner deck portion comprising:

an inner base surface;

an inner top structural layer in opposition to and above the inner base surface; and an inner edge disposed adjacent to a longitudinal portion of a perimeter of the inner base surface, wherein a lowest portion of the inner edge is disposed flush with the longitudinal portion of the perimeter of the inner base surface; and an outer deck portion disposed adjacent to a longitudinal portion of a perimeter of the inner deck portion, the outer deck portion comprising:

an outer base surface;

an outer top structural layer in opposition to and above the outer base surface; and an outer edge disposed adjacent to a longitudinal portion of a perimeter of the outer base surface, wherein a region of the inner top structural layer is recessed such that the region of the inner top structural layer is vertically lower than and substantially parallel with a laterally adjacent region of the outer top structural layer, forming a longitudinal upper step along an interface between the laterally adjacent and substantially parallel regions of the inner top structural layer and the outer top structural layer, wherein a lateral width of the outer top structural layer is significantly greater than a lateral width of the longitudinal upper step and at least a portion of the inner edge is laterally intermediate at least a portion of the longitudinal upper step and the outer edge.

2. The deck of claim 1, wherein the inner edge is lower than the outer edge when the deck is positioned substantially horizontal.

3. The deck of claim 1, wherein the inner base surface is substantially parallel to the outer base surface.

4. The deck of claim 1, further comprising an inner top surface above the inner top structural layer and an outer top surface above the outer top structural layer, wherein the inner top surface includes a binding region that is configured and arranged to receive a foot binding such that a region of the outer top surface that is laterally adjacent to the binding region is flush with the binding region.

5. The deck of claim 1, further comprising a longitudinal lower step along an interface between laterally adjacent portions of the inner base surface and the outer base surface and wherein the inner edge is further disposed longitudinally along the lower step.

6. The deck of claim 5, wherein the longitudinal upper step is substantially above the lower step for at least a portion of a longitudinal length of the upper step.

7. The deck of claim 1, wherein the deck is configured and arranged to glide on a surface that includes liquid water molecules.

8. The deck of claim 1, wherein a ratio between a width of the recessed inner top structural layer to a width of a waist region of the deck is between 0.95 and 0.99.

9. The deck of claim 1, wherein a ratio between a surface area of the recessed inner top structural layer to a surface area of the deck is between 0.70 and 0.90.

10. The deck of claim 1, wherein a ratio between a surface area of the recessed inner top structural layer to a surface area of the deck is approximately 0.8.

11. A sled structure configured and arranged for gliding on snow, the sled structure comprising:

a top deck surface comprising:

an inner top surface;

an outer top surface that includes an outer top surface portion that is disposed vertically higher than and substantially parallel with at least a portion of the inner top surface; and an upper step that is disposed along an upper interface between the substantially parallel and laterally adjacent portions of the inner top surface and the outer top surface, wherein a lateral width of the outer top surface is significantly greater than a lateral width of the upper step; and a base deck surface comprising:

an inner base surface in opposition to and below the inner top surface;

an outer base surface disposed laterally adjacent to the inner base surface and in opposition to and below the outer top surface;

an inner edge disposed along a lower interface formed by laterally adjacent portions of the inner base surface and the outer base surface, wherein a lowest portion of the inner edge is disposed flush with the laterally adjacent of the inner base surface; and an outer edge disposed at an outer perimeter of the outer base surface, wherein an outermost portion of the inner edge is laterally intermediate an outermost portion of the upper step and the outer edge, such that the outermost portion of the inner edge is disposed directly below a region of the outer top surface portion that is substantially parallel with the portion of the inner top surface.

12. The sled structure of claim 11, wherein the inner edge includes an inner sidecut profile and the outer edge includes an outer sidecut profile.

13. The sled structure of claim 11, further comprising a longitudinal lower step along an interface between laterally adjacent portions of the inner base surface and the outer base surface and wherein the inner edge is further disposed longitudinally along the lower step.

14. The sled structure of claim 11, wherein the sled structure is at least one of a snowboard or a snow ski.

15. A deck comprising:

an upper deck surface that includes and outer region, an inner region that is lower than and substantially parallel to the outer region, and an upper step that is laterally intermediate the outer region and the inner region, wherein a lateral width of the outer region is significantly greater than a lateral width of the upper step;

a lower deck surface configured and arranged to glide on a surface;

a longitudinal axis of symmetry that subdivides the deck into a first longitudinal portion and a second longitudinal portion;

an outer snow carving means disposed on the lower deck surface of the first longitudinal portion; and an inner snow carving means disposed on the lower deck surface of the first longitudinal portion, wherein a substantially flat lowest portion of the inner snow carving means a lowest is disposed flush with and substantially parallel to a lowest portion of the lower deck surface and intermediate the outer snow carving means and the longitudinal axis of symmetry, wherein the substantially flat lowest portion of the inner snow carving means that is substantially parallel to the lowest portion of the lower deck surface is laterally intermediate a portion of the upper step and the outer snow carving means.

* * * * *